US011636789B2

(12) United States Patent
Dong et al.

(10) Patent No.: US 11,636,789 B2
(45) Date of Patent: Apr. 25, 2023

(54) PIXEL UNIT, ARRAY SUBSTRATE, DISPLAY PANEL, DISPLAY APPARATUS, AND DETECTION METHOD OF PIXEL CIRCUIT

(71) Applicant: BOE TECHNOLOGY GROUP CO., LTD., Beijing (CN)

(72) Inventors: Tian Dong, Beijing (CN); Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/418,559

(22) PCT Filed: Aug. 13, 2020

(86) PCT No.: PCT/CN2020/109008
§ 371 (c)(1),
(2) Date: Jun. 25, 2021

(87) PCT Pub. No.: WO2021/027897
PCT Pub. Date: Feb. 18, 2021

(65) Prior Publication Data

US 2022/0076602 A1 Mar. 10, 2022

(30) Foreign Application Priority Data

Aug. 14, 2019 (CN) ..... 201910748921.9

(51) Int. Cl.
*G09G 3/00* (2006.01)
*G09G 3/3225* (2016.01)

(52) U.S. Cl.
CPC ..... *G09G 3/006* (2013.01); *G09G 3/3225* (2013.01); *G09G 2300/0842* (2013.01);
(Continued)

(58) Field of Classification Search
CPC .... G09G 3/006; G09G 3/3225; G09G 3/3233; G09G 2300/0842; G09G 2300/0819;
(Continued)

(56) References Cited

U.S. PATENT DOCUMENTS

2011/0018858 A1* 1/2011 Ryu ..... G09G 3/3233 345/82
2012/0086694 A1* 4/2012 Tseng ..... G09G 3/3233 345/212

(Continued)

FOREIGN PATENT DOCUMENTS

CN 101697268 A 4/2010
CN 105931600 A 9/2016

(Continued)

OTHER PUBLICATIONS

First Office Action of priority application No. CN 201910748921.9 issued by the China Patent Office dated Aug. 4, 2020.

*Primary Examiner* — David Tung
(74) *Attorney, Agent, or Firm* — IP & T Group LLP

(57) ABSTRACT

A pixel unit includes a pixel circuit, a light-emitting element, a first sensing line and a second sensing line. The pixel circuit is electrically connected to the light-emitting element, and the pixel circuit includes a driving sub-circuit. The driving sub-circuit has a control terminal, a first terminal and a second terminal. The first terminal of the driving sub-circuit is configured to be electrically connected to a first power supply terminal, and is electrically connected to the first sensing line. The second terminal of the driving sub-circuit is electrically connected to the light-emitting element. The control terminal of the driving sub-circuit is electrically connected to the second sensing line. The first sensing line is configured to sense a voltage of the first terminal of the driving sub-circuit. The second sensing line is configured to sense a voltage of the control terminal of the driving sub-circuit.

19 Claims, 15 Drawing Sheets

(52) U.S. Cl.
CPC ... *G09G 2310/061* (2013.01); *G09G 2310/08* (2013.01); *G09G 2320/0233* (2013.01); *G09G 2330/021* (2013.01)

(58) Field of Classification Search
CPC ..... G09G 2300/0861; G09G 2310/061; G09G 2310/08; G09G 2310/0251; G09G 2320/0233; G09G 2320/0295; G09G 2320/045; G09G 2330/021; G01R 19/10
See application file for complete search history.

(56) References Cited

U.S. PATENT DOCUMENTS

| | | | | |
|---|---|---|---|---|
| 2013/0235023 | A1 | 9/2013 | Chaji et al. | |
| 2015/0187276 | A1* | 7/2015 | Shim | G09G 3/3291 345/77 |
| 2015/0243226 | A1* | 8/2015 | Kumeta | G09G 3/3233 345/207 |
| 2016/0104423 | A1* | 4/2016 | Park | G09G 3/3233 345/78 |
| 2016/0203764 | A1* | 7/2016 | In | G09G 3/3291 345/215 |
| 2016/0365037 | A1* | 12/2016 | Gu | G09G 3/3258 |
| 2018/0033367 | A1 | 2/2018 | Kim et al. | |
| 2020/0118488 | A1* | 4/2020 | Kim | G09G 3/3291 |

FOREIGN PATENT DOCUMENTS

| | | | |
|---|---|---|---|
| CN | 107665664 | A | 2/2018 |
| CN | 109119024 | A | 1/2019 |
| CN | 109377944 | A | 2/2019 |
| CN | 109523952 | A | 3/2019 |
| CN | 110428776 | A | 11/2019 |

* cited by examiner

PIXEL UNIT, ARRAY SUBSTRATE, DISPLAY PANEL, DISPLAY APPARATUS, AND DETECTION METHOD OF PIXEL CIRCUIT

CROSS-REFERENCE TO RELATED APPLICATIONS

This application is a national phase entry under 35 USC 371 of International Patent Application No. PCT/CN2020/109008, filed on Aug. 13, 2020, which claims priority to Chinese Patent Application No. 201910748921.9, filed on Aug. 14, 2019, which are incorporated herein by reference in their entirety.

TECHNICAL FIELD

The present disclosure relates to the field of display technologies, and in particular, to a pixel unit, an array substrate, a display panel, a display apparatus, and a detection method of a pixel circuit.

BACKGROUND

An organic light-emitting diode (OLED) display panel has characteristics of wide viewing angle, high contrast, fast response speed, etc. Compared with an inorganic light-emitting display device, an organic light-emitting diode included in the OLED display panel has a higher luminous brightness and a lower driving voltage. Due to the above characteristics, the organic light-emitting diode (OLED) display panel may be applied to apparatuses with display functions such as mobile phones, displays, notebook computers, digital cameras, and instruments.

SUMMARY

In an aspect, a pixel unit is provided. The pixel unit includes a pixel circuit, a light-emitting element, a first sensing line and a second sensing line. The pixel circuit is electrically connected to the light-emitting element. The pixel circuit includes a driving sub-circuit configured to drive the light-emitting element electrically connected to the pixel circuit to emit light. The driving sub-circuit has a control terminal, a first terminal and a second terminal. The first terminal of the driving sub-circuit is configured to be electrically connected to a first power supply terminal, so as to receive a first power voltage provided by the first power supply terminal. The first terminal of the driving sub-circuit is further electrically connected to the first sensing line. The second terminal of the driving sub-circuit is electrically connected to the light-emitting element. The control terminal of the driving sub-circuit is electrically connected to the second sensing line. The first sensing line is configured to sense a voltage of the first terminal of the driving sub-circuit. The second sensing line is configured to sense a voltage of the control terminal of the driving sub-circuit.

In some embodiments, the driving sub-circuit includes a first transistor. A control terminal of the first transistor is the control terminal of the driving sub-circuit, a first terminal of the first transistor is the first terminal of the driving sub-circuit, and a second terminal of the first transistor is the second terminal of the driving sub-circuit.

In some embodiments, the pixel circuit further includes a compensation connection sub-circuit, a first storage sub-circuit and a sensing connection sub-circuit. The compensation connection sub-circuit is electrically connected to the control terminal and the second terminal of the driving sub-circuit. The compensation connection sub-circuit is configured to receive a first sensing control signal, and electrically connect the second terminal of the driving sub-circuit and the control terminal of the driving sub-circuit. The first storage sub-circuit is electrically connected to the control terminal and the first terminal of the driving sub-circuit. The first storage sub-circuit is configured to store a signal written into the control terminal of the driving sub-circuit. The sensing connection sub-circuit is electrically connected to the control terminal of the driving sub-circuit. The sensing connection sub-circuit is further electrically connected to the second sensing line. The sensing connection sub-circuit is configured to receive a second sensing control signal, and electrically connect the control terminal of the driving sub-circuit to the second sensing line.

In some embodiments, the compensation connection sub-circuit includes a second transistor. A control terminal of the second transistor is configured to receive the first sensing control signal, a first terminal of the second transistor is electrically connected to the control terminal of the driving sub-circuit, and a second terminal of the second transistor is electrically connected to the second terminal of the driving sub-circuit. The first storage sub-circuit includes a first storage capacitor. A first terminal of the first storage capacitor is electrically connected to the control terminal of the driving sub-circuit, and a second terminal of the first storage capacitor is electrically connected to the first terminal of the driving sub-circuit. The sensing connection sub-circuit includes a third transistor. A control terminal of the third transistor is configured to receive the second sensing control signal, a first terminal of the third transistor is electrically connected to the control terminal of the driving sub-circuit, and a second terminal of the third transistor is electrically connected to the second sensing line.

In some embodiments, the control terminal of the second transistor is configured to be electrically connected to a first sensing control line, the control terminal of the third transistor is configured to be electrically connected to a second sensing control line, and the first sensing control line and the second sensing control line are a same control line. Or the control terminal of the second transistor is configured to be electrically connected to a first sensing control line, the control terminal of the third transistor is configured to be electrically connected to a second sensing control line, and the first sensing control line and the second sensing control line are different control lines; and the second sensing line is also used as a data line.

In some embodiments, the pixel circuit further includes a reset sub-circuit. The reset sub-circuit is electrically connected to the second sensing line. The reset sub-circuit is configured to receive a reset control signal and a reset signal, so as to perform a reset operation on the control terminal of the driving sub-circuit.

In some embodiments, the reset sub-circuit includes a fourth transistor. A control terminal of the fourth transistor is configured to receive the reset control signal, a first terminal of the fourth transistor is configured to receive the reset signal, and a second terminal of the fourth transistor is electrically connected to the second sensing line.

In some embodiments, the pixel circuit further includes a data writing sub-circuit. The data writing sub-circuit is electrically connected to the control terminal of the driving sub-circuit. The pixel unit further includes a data line, and the data writing sub-circuit is further electrically connected to the data line. Or, the second sensing line is also used as a data line, and the data writing sub-circuit is further electrically connected to the second sensing line. The data writing sub-circuit is configured to receive a scan control signal, and write a data signal into the control terminal of the driving sub-circuit.

In some embodiments, the data writing sub-circuit includes a fifth transistor. A control terminal of the fifth transistor is configured to receive the scan control signal, a first terminal of the fifth transistor is electrically connected to the second sensing line or the data line, and a second terminal of the fifth transistor is electrically connected to the control terminal of the driving sub-circuit.

In some embodiments, the second terminal of the driving sub-circuit is electrically connected to a first terminal of the light-emitting element. The pixel circuit further includes a voltage selection sub-circuit. The voltage selection sub-circuit is configured to selectively electrically connect a second terminal of the light-emitting element to one of the first power supply terminal and a second power supply terminal. The second power supply terminal is configured to provide a second power supply voltage, and the second power supply voltage is less than the first power supply voltage.

The voltage selection sub-circuit includes a first power supply voltage supply sub-circuit and a second power supply voltage supply sub-circuit. The first power supply voltage supply sub-circuit is electrically connected to the first power supply terminal and the second terminal of the light-emitting element. The first power supply voltage supply sub-circuit is configured to receive a third sensing control signal, and electrically connect the second terminal of the light-emitting element to the first power supply terminal. The second power supply voltage supply sub-circuit is electrically connected the second power supply terminal and the second terminal of the light-emitting element. The second power supply voltage supply sub-circuit is configured to receive a light-emitting control signal, and electrically connect the second terminal of the light-emitting element to the second power supply terminal.

In some embodiments, the first power supply voltage supply sub-circuit includes a sixth transistor. A control terminal of the sixth transistor is configured to receive the third sensing control signal, a first terminal of the sixth transistor is configured to be electrically connected to the first power supply terminal, and a second terminal of the sixth transistor is configured to be electrically connected to the second terminal of the light-emitting element. The second power supply voltage supply sub-circuit includes a seventh transistor. A control terminal of the seventh transistor is configured to receive the light-emitting control signal, a first terminal of the seventh transistor is configured to be electrically connected to the second power supply terminal, and a second terminal of the seventh transistor is configured to be electrically connected to the second terminal of the light-emitting element.

In some embodiments, the second terminal of the driving sub-circuit is electrically connected to a first terminal of the light-emitting element. A second terminal of the light-emitting element is electrically connected to a variable power supply terminal, and the variable power supply terminal is configured to provide the first power supply voltage and a second power supply voltage. The second power supply voltage is less than the first power supply voltage.

In some embodiments, the driving sub-circuit includes a first transistor. A control terminal of the first transistor is the control terminal of the driving sub-circuit, a first terminal of the first transistor is the first terminal of the driving sub-circuit, and a second terminal of the first transistor is the second terminal of the driving sub-circuit. The pixel circuit further includes a first storage capacitor, a second transistor, a third transistor, a fourth transistor, a fifth transistor, a sixth transistor and a seventh transistor.

The control terminal of the first transistor is electrically connected to a first node, the first terminal of the first transistor is configured to be electrically connected to the first power supply terminal, and the second terminal of the first transistor is electrically connected to a second node. A first terminal of the first storage capacitor is electrically connected to the first node, and a second terminal of the first storage capacitor is electrically connected to the first terminal of the first transistor. A control terminal of the second transistor is configured to receive a first sensing control signal, a first terminal of the second transistor is electrically connected to the first node, and a second terminal of the second transistor is electrically connected to the second node.

A control terminal of the third transistor is configured to receive a second sensing control signal, a first terminal of the third transistor is electrically connected to the first node, and a second terminal of the third transistor is electrically connected to the second sensing line. The control terminal of the second transistor is configured to be electrically connected to a first sensing control line, the control terminal of the third transistor is configured to be electrically connected to a second sensing control line, and the first sensing control line and the second sensing control line are a same control line. Or the control terminal of the second transistor is configured to be electrically connected to a first sensing control line, the control terminal of the third transistor is configured to be electrically connected to a second sensing control line, and the first sensing control line and the second sensing control line are different control lines; and the second sensing line is also used as a data line.

A control terminal of the fourth transistor is configured to receive a reset control signal, a first terminal of the fourth transistor is configured to receive a reset signal, and a second terminal of the fourth transistor is electrically connected to the second sensing line. A control terminal of the fifth transistor is configured to receive a scan control signal, a second terminal of the fifth transistor is electrically connected to the first node, and a first terminal of the fifth transistor is connected to the second sensing line, and the second sensing line is also used as the data line. Or, the pixel unit further includes a data line, and the first terminal of the fifth transistor is electrically connected to the data line.

A control terminal of the sixth transistor is configured to receive a third sensing control signal, a first terminal of the sixth transistor is configured to be electrically connected to the first power supply terminal, and a second terminal of the sixth transistor is configured to be electrically connected to a second terminal of the light-emitting element. A control terminal of the seventh transistor is configured to receive a light-emitting control signal, a first terminal of the seventh transistor is configured to be electrically connected to a second power supply terminal, and a second terminal of the seventh transistor is configured to be electrically connected to the second terminal of the light-emitting element.

In another aspect, an array substrate is provided. The array substrate includes a plurality of pixel units arranged in an array. The plurality of pixel units are pixel units as described in any one of the above.

In some embodiments, at least two of the plurality of pixel units share a same first sensing line.

In some embodiments, the array substrate further includes at least one first power bus. The power bus is configured to be electrically connected to the first power supply terminal, and is electrically connected to the plurality of pixel units, so as to provide the first power supply voltage to the plurality of pixel units. The first sensing line is electrically connected to the first power bus.

In some embodiments, first sensing lines in the plurality of pixel units are independent of each other.

In yet another aspect, a display panel is provided. The display panel includes the array substrate as described in any one of the above.

In yet another aspect, a display apparatus is provided. The display apparatus includes the display panel as described above and a detection circuit. The detection circuit includes at least one first signal terminal and a plurality of second signal terminals. The at least one first signal terminal is electrically connected to the first sensing line, and each of the plurality of second signal terminals is electrically connected to one second sensing line. The detection circuit is configured to receive voltages detected by the first sensing line and the second sensing line, and to obtain a threshold voltage of a driving transistor in the pixel circuit electrically connected to the first sensing line and the second sensing line according to the received voltages.

In yet another aspect, a detection method of a pixel circuit is provided. The pixel circuit is the pixel circuit in the pixel unit as described above, and the pixel circuit includes a driving sub-circuit including a driving transistor. The detection method includes: detecting a voltage of a first terminal of the driving transistor through the first sensing line, and detecting a voltage of a control terminal of the driving transistor through the second sensing line. The first terminal of the driving transistor is configured to be electrically connected to the first power supply terminal, so as to receive the first power supply voltage provided by the first power supply terminal. The voltage of the first terminal of the driving transistor and the voltage of the control terminal of the driving transistor are configured to obtain a threshold voltage of the driving transistor in the pixel circuit. The threshold voltage is equal to a difference value between the voltage of the control terminal of the driving transistor and the voltage of the first terminal of the driving transistor.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described are merely accompanying drawings of some embodiments of the present disclosure, and a person of ordinary skill in the art may obtain other drawings according to these drawings. In addition, the accompanying drawings to be described may be regarded as schematic diagrams, and are not limitations on an actual size of a product, an actual process of a method and an actual timing of a signal to which the embodiments of the present disclosure relate.

DETAILED DESCRIPTION

Figure 1:
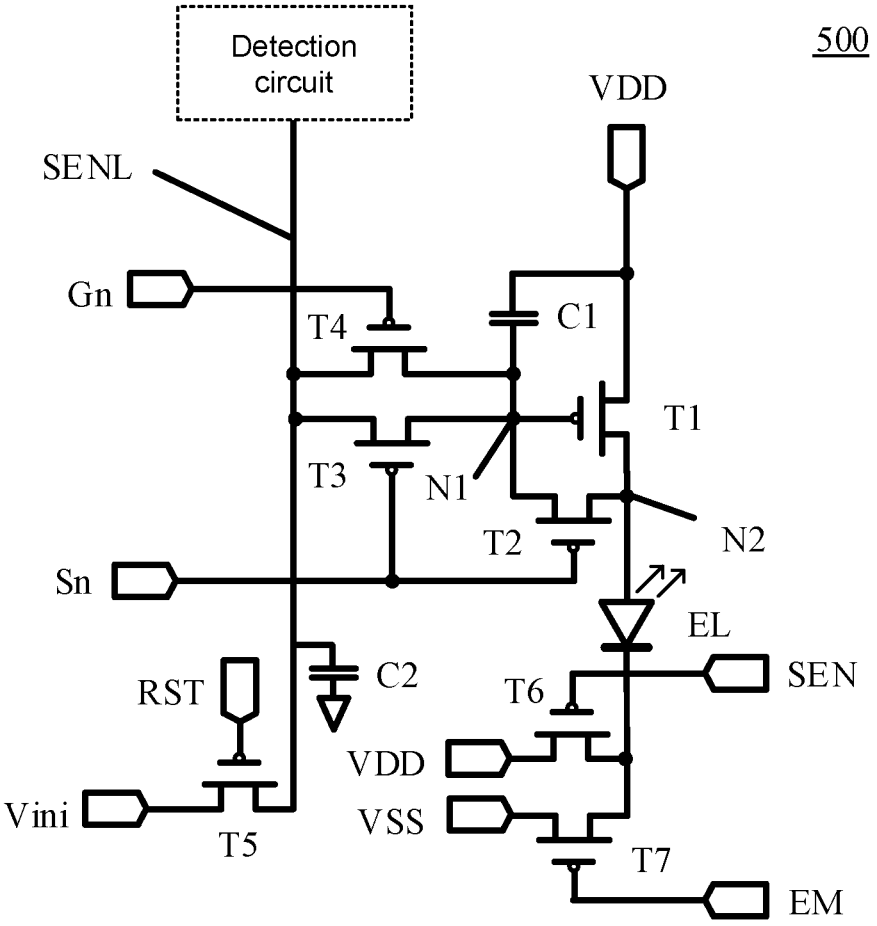
FIG. 1 is a schematic diagram of a pixel circuit.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, the term "comprise" and other forms thereof such as the third-person singular form "comprises" and the present participle form "comprising" throughout the description and the claims are construed as an open and inclusive meaning, i.e., "including, but not limited to". In the description of the specification, the terms such as "one embodiment", "some embodiments", "exemplary embodiments", "an example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

In the description of the embodiments of the present disclosure, the term "a plurality of/the plurality of" means two or more unless otherwise specified.

The use of "applicable to" or "configured to" herein means an open and inclusive language, which does not exclude devices that are applicable to or configured to perform additional tasks or steps.

In addition, the use of "based on" is meant to be open and inclusive, in that a process, step, calculation or other action that is "based on" one or more of the stated conditions or values may, in practice, be based on additional conditions or values exceeding those stated.

Unless otherwise defined, technical and scientific terms used herein should have meanings that are commonly understood by one of ordinary skill in the art to which the present disclosure belongs. Words such as "first", "second", or the like, used in the present disclosure are not intended to mean any order, quantity or importance, but are merely used to distinguish different components. Similarly, a word such as "include" or "comprise" means that an element or an object appearing before the word covers element(s) or object(s) listed after the word and equivalents thereof without excluding other elements or objects. A word such as "connect", "couple" is not limited to a physical or mechanical connection, but may include an electrical connection, whether direct or indirect. "Upper", "lower", "left", "right", etc., are only used to indicate a relative positional relationship, and when the absolute position of the described object is changed, the relative positional relationship may also be changed accordingly.

At present, Consumers' requirements for the size and resolution of a display device are increasing, and thus requirements for production processes are also increasing. However, in a production and manufacturing process of the display device at present, the display device may show moire (also referred to as Mura) during display due to influences of factors such as production process and manufacturing technology. The moire is, for example, a phenomenon of brightness non-uniformity caused by display deviations (e.g., brightness deviations) of pixel units in the display device. In a case where the moire is present in the display device, the picture quality of the display device will be accordingly reduced, thereby reducing usage experiences of users.

It is noted that the brightness non-uniformity is a major problem currently faced by the organic light-emitting diode (OLED) display panel. In order to solve the technical problem about the brightness non-uniformity of the OLED display panel, in addition to the improvement of manufacturing process, researchers further propose an internal compensation technique and an external compensation technique.

It is noted that, in a case of the display deviations, if only the internal compensation technique is used, the effect of improving brightness uniformity is limited. In this case, the compensation effect of the OLED display panel may be improved by, for example, the external compensation technique. The following exemplary description is made in combination with a medium- and small-sized OLED display panel (e.g., a display panel for a mobile terminal).

For example, low temperature poly-silicon thin film transistors (LTPS TFT) are usually used in the medium- and small-sized OLED display panel, in that the mobility of the LTPS TFT is large, and an area occupied by the transistor is small, which is suitable for manufacturing a display panel with a high PPI (i.e., the number of pixels per inch). For OLED pixel circuits used in the medium- and small-sized OLED display panel, due to a limitation of a crystallization process for forming polysilicon active layers of thin film transistors (TFT), the LTPS TFTs at different positions may have non-uniformity in electrical parameters such as threshold voltage and mobility. This non-uniformity may be converted into current differences and brightness differences among the pixel units in the OLED display panel, and is sensed by human eyes (i.e., the moire phenomenon).

At present, the internal compensation technique or the external compensation technique may be used to deal with the brightness non-uniformity and a residual image problem of the OLED display panel. The internal compensation technique refers to a compensation method using a compensation sub-circuit constructed with TFTs in a pixel. The external compensation technique refers to a method of sensing electrical or optical characteristics of a pixel through an external driving circuit or an external device, and then compensating for a data signal to be displayed. In a case where the display panel is a quarter high definition (QHD, 2560×1440 and above) display panel, since a circuit structure of the OLED display panel is complex and the manufacturing process is difficult, it is sometimes difficult to completely eliminate the moire phenomenon of a display screen if the display panel is only internally compensated. Therefore, in order to improve a yield and/or a display quality of the display panel and suppress the moire phenomenon, the external compensation technique may be used (for example, the external compensation technique is used on a basis of an internal compensation) to further improve the yield and/or the display quality of the display panel.

The external compensation technique is a technique used for eliminating or suppressing the moire of the display device and improving the brightness uniformity of the display screen. As an example, FIG. 1 is a schematic diagram of a pixel circuit to which the external compensation technique may be applied.

It will be noted that, for convenience of description, FIG. 1 further shows a detection circuit. For example, the pixel circuit shown in FIG. 1 may be implemented as a 4T1C pixel circuit. That is, a core circuit of the pixel circuit shown in FIG. 1 is of four transistors and a capacitor.

As shown in FIG. 1, the pixel circuit 500 includes a first transistor T1, a storage capacitor C1, a second transistor T2, a third transistor T3, a fourth transistor T4, a fifth transistor T5, a sixth transistor T6, and a seventh transistor T7.

As shown in FIG. 1, the first transistor T1 is configured to be a driving transistor, and is configured to be able to drive a light-emitting element EL electrically connected to the pixel circuit 500 to emit light. A first terminal of the first transistor T1 is connected to a first power supply terminal VDD, so as to receive a first power supply voltage provided from the first power supply terminal VDD. A second terminal of the first transistor T1 is configured to be electrically connected to the light-emitting element EL, so as to supply a driving current to the light-emitting element EL.

As shown in FIG. 1, the seventh transistor T7 is configured to be able to electrically connect the light-emitting element EL and a second power supply terminal VSS, the second power supply terminal VSS is configured to provide a second power supply voltage, and the second power supply voltage is less than the first power supply voltage. For example, the first power supply terminal VDD and the second power supply terminal VSS may be a part of a power supply of a display apparatus including the pixel circuit 500.

It is noted that, a threshold voltage of the first transistor T1 may be obtained (e.g., estimated) through a following threshold detection method. The first power supply voltage provided from the first power supply terminal VDD is used for charging a control terminal of the driving transistor (the first transistor T1). When the charging is completed or the charging is nearly completed, the detection circuit 20 is used for obtaining a voltage of the control terminal of the first transistor T1. Then, a difference value between the voltage of the control terminal of the first transistor T1 obtained by the detection circuit and a theoretical value or a design value (for example, the theoretical value or the design value is a constant value) of the first power supply voltage output from the first power supply terminal VDD is used as the threshold voltage of the first transistor T1.

However, it is noted that, an actual value of the first power supply voltage output from the first power supply terminal VDD fluctuates (that is, the actual value of the first power supply voltage output from the first power supply terminal VDD and the theoretical value or the design value of the first power supply voltage output from the first power supply terminal VDD have a difference therebetween, and the difference varies with time). Moreover, a value of a voltage received by the first terminal of the first transistor T1 and the actual value of the first power supply voltage output from the first power supply terminal VDD have a difference therebetween, which affects an accuracy of the threshold detection method.

Based on this, at least one embodiment of the present disclosure provides a pixel unit, an array substrate, a display panel, a display apparatus, a detection method of a pixel circuit, and a driving method of a display apparatus.

The pixel unit in some embodiments of the present disclosure includes a pixel circuit, a first sensing line and a second sensing line. The pixel circuit is electrically connected to a light-emitting element. The pixel circuit includes a driving sub-circuit, and the driving sub-circuit is configured to be able to drive the light-emitting element electrically connected to the pixel circuit to emit light. The driving sub-circuit has a control terminal, a first terminal and a second terminal. The first terminal of the driving sub-circuit is configured to be electrically connected to a first power supply terminal, so as to receive a first power supply voltage provided from the first power supply terminal. The first terminal of the driving sub-circuit is further configured to be electrically connected to the first sensing line. The second terminal of the driving sub-circuit is configured to be electrically connected to the light-emitting element. The control terminal of the driving sub-circuit is configured to be electrically connected to the second sensing line. The first sensing line is configured to sense a voltage of the first terminal of the driving sub-circuit. The second sensing line is configured to sense a voltage of the control terminal of the driving sub-circuit. The detection method of the pixel circuit, the array substrate, the display panel, the display apparatus, and the driving method of the display apparatus may improve an accuracy of a threshold detection result of the pixel circuit and display effects of the display panel and the display apparatus.

The pixel unit, the array substrate, the display panel, the display apparatus, the detection method of the pixel circuit and the driving method of the display apparatus in the embodiments of the present disclosure will be non-limitedly described below through several examples and embodiments. As described below, different features in these specific examples and embodiments may be combined with each other without conflicting with each other, so as to obtain new examples and embodiments, and these new examples and embodiments are also included in the protection scope of the present disclosure.

Figure 2:
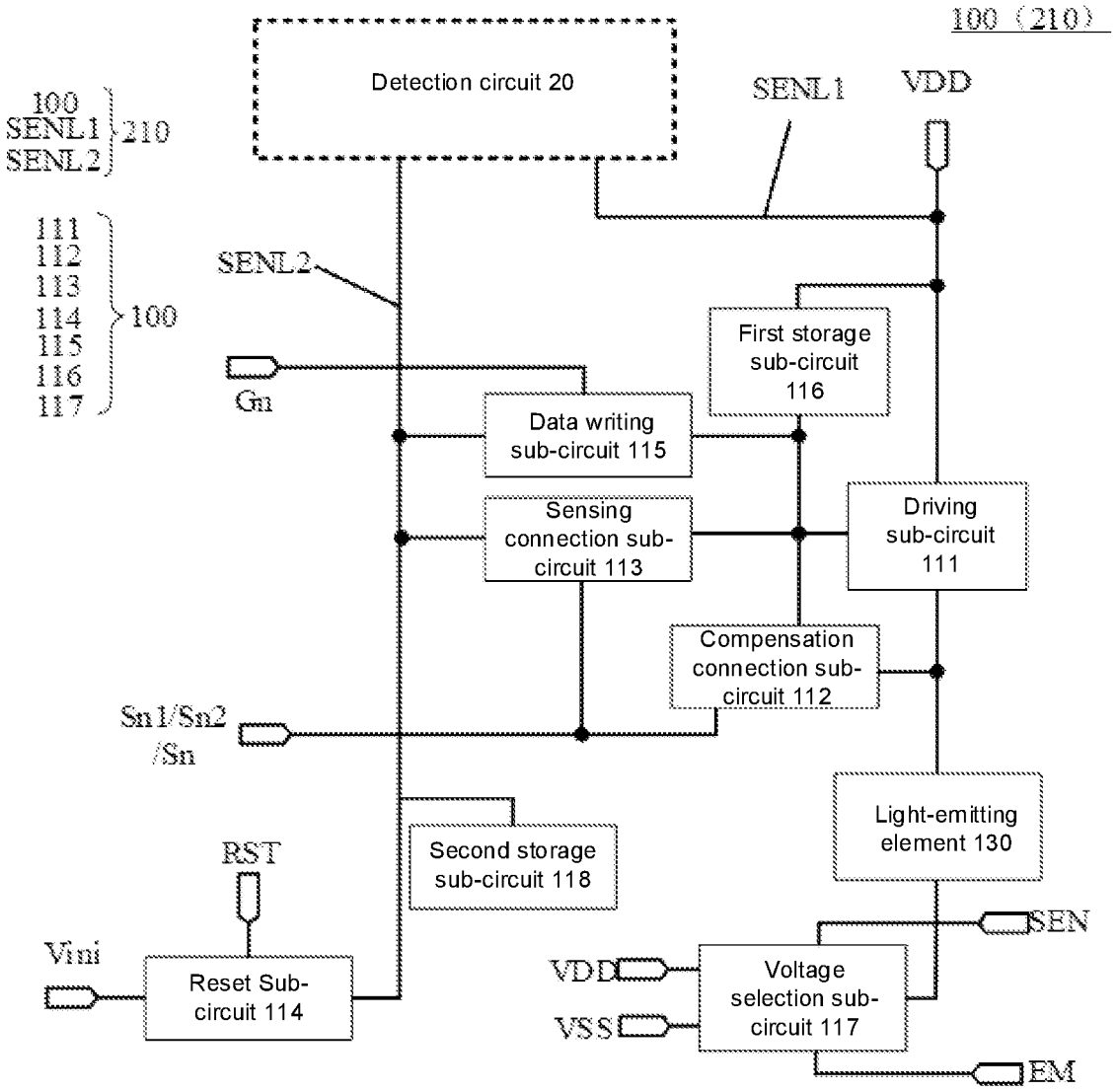
FIG. 2 is a structural diagram of a pixel circuit, in accordance with some embodiments of the present disclosure.

FIG. 2 is a schematic block diagram of a pixel unit 210 in at least one embodiment of the present disclosure. As shown in FIG. 2, the pixel unit 210 includes a pixel circuit 100, a first sensing line SENL1 and a second sensing line SENL2. The pixel circuit 100 is electrically connected to a light-emitting element 130. The pixel circuit 100 includes a driving sub-circuit 111, and the driving sub-circuit 111 is configured to be able to drive the light-emitting element 130 electrically connected to the pixel circuit 100 to emit light. The driving sub-circuit 111 has a control terminal, a first terminal and a second terminal. The first terminal of the driving sub-circuit 111 is configured to be electrically connected to a first power supply terminal VDD, so as to receive a first power supply voltage provided from the first power supply terminal VDD. The first terminal of the driving sub-circuit 111 is further configured to be electrically connected (for example, directly electrically connected or indirectly electrically connected) to the first sensing line SENL1. The second terminal of the driving sub-circuit 111 is configured to be electrically connected (for example, directly electrically connected or indirectly electrically connected) to the light-emitting element 130. The control terminal of the driving circuit 111 is configured to be electrically connected to the second sensing line SENL2.

Figure 3:
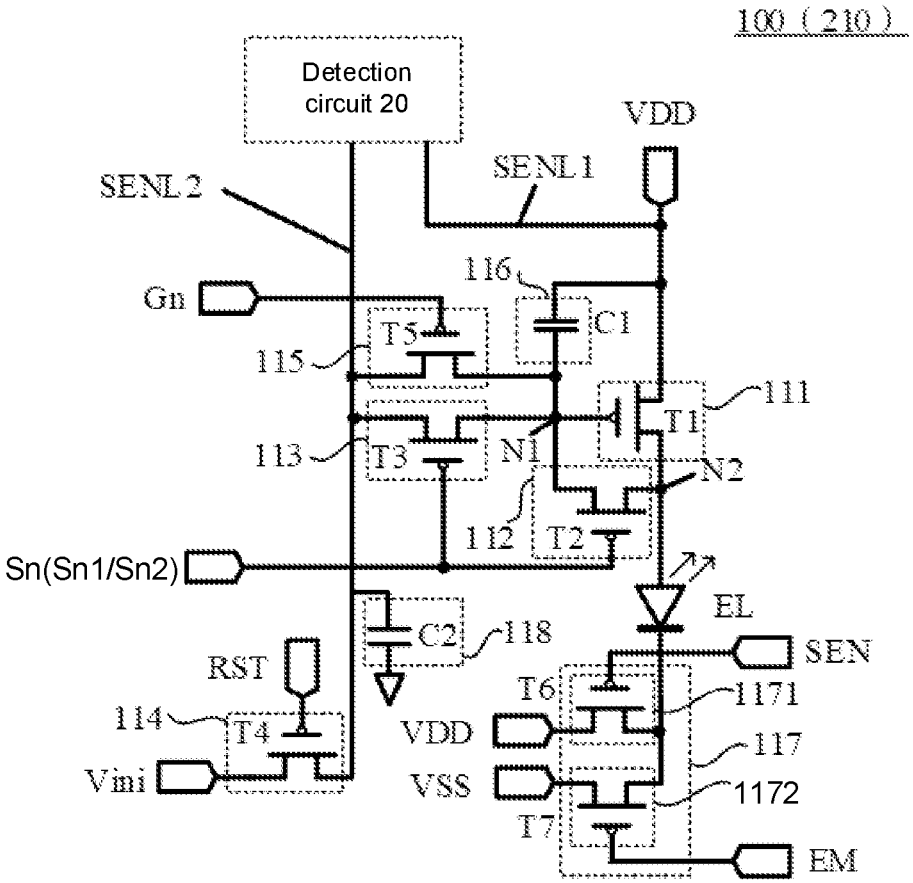
FIG. 3 is a structural diagram of another pixel circuit, in accordance with some embodiments of the present disclosure.

The first sensing line SENL1 is configured to sense a voltage of the first terminal of the driving sub-circuit 111. The second sensing line SENL2 is configured to sense a voltage of the control terminal of the driving sub-circuit 111. For example, by providing the first sensing line SENL1 and the second sensing line SENL2, the accuracy of the threshold voltage detection of the driving transistor may be improved. An exemplary description is made below in combination with FIGS. 2 and 3. FIG. 3 is an example of the pixel circuit 100 shown in FIG. 2.

It will be noted that, for convenience of description, FIGS. 2 and 3 further show a detection circuit 20. For example, the detection circuit 20 includes a first signal terminal 241 (not shown in FIGS. 2 and 3, see FIG. 10) and a second signal terminal 242 (not shown in FIGS. 2 and 3, see FIG. 10). The first signal terminal 241 is configured to be electrically connected to the first sensing line SENL1, and the second signal terminal 242 is configured to be electrically connected to the second sensing line SENL2.

For example, as shown in FIGS. 2 and 3, the driving sub-circuit 111 includes a first transistor T1. A control terminal of the first transistor T1 is configured to be the control terminal of the driving sub-circuit 111, a first terminal of the first transistor T1 is configured to be the first terminal of the driving sub-circuit 111, and a second terminal of the first transistor T1 is configured to be the second terminal of the driving sub-circuit 111. The control terminal of the first transistor T1 is configured to be electrically connected to a first node N1, the first terminal of the first transistor T1 is configured to be electrically connected to the first power supply terminal VDD, and the second terminal of the first transistor T1 is configured to be electrically connected to a second node N2.

In some embodiments, as shown in FIG. 2, the pixel circuit 100 further includes a first storage sub-circuit 116, and the first storage sub-circuit 116 is configured to be electrically connected to the control terminal and the first terminal of the driving sub-circuit 111. The first storage sub-circuit 116 is configured to store a signal written into the control terminal of the driving sub-circuit 111.

For example, as shown in FIGS. 2 and 3, the first storage sub-circuit 116 includes a first storage capacitor C1. A first terminal of the first storage capacitor C1 is configured to be electrically connected to the control terminal of the driving sub-circuit 111, and a second terminal of the first storage capacitor C1 is configured to be electrically connected to the first terminal of the driving sub-circuit 111. For example, as shown in FIG. 3, the first terminal of the first storage capacitor C1 is configured to be connected to the first node N1, and the second terminal of the first storage capacitor C1 is configured to be connected to the first terminal of the first transistor T1.

In some embodiments, as shown in FIG. 2, the pixel circuit 100 further includes a compensation connection sub-circuit 112. The compensation connection sub-circuit 112 is configured to receive a first sensing control signal, and is electrically connected to the control terminal and the second terminal of the driving sub-circuit 111. The compensation connection sub-circuit 112 is configured to electrically connect the second terminal of the driving sub-circuit 111 and the control terminal of the driving sub-circuit 111.

For example, as shown in FIGS. 2 and 3, the compensation connection sub-circuit 112 includes a second transistor T2. A control terminal of the second transistor T2 is configured to receive the first sensing control signal, a first terminal of the second transistor T2 is configured to be electrically connected to the control terminal of the driving sub-circuit 111, and a second terminal of the second transistor T2 is configured to be electrically connected to the second terminal of the driving sub-circuit 111. For example, as shown in FIG. 3, the first terminal of the second transistor T2 is configured to be electrically connected to the first node N1, the second terminal of the second transistor T2 is configured to be electrically connected to the second node N2, and the control terminal of the second transistor T2 is configured to be electrically connected to a first sensing control line Sn1, so as to receive the first sensing control signal transmitted by the first sensing control line Sn1. The second transistor T2 electrically connects the control terminal of the first transistor T1 and the second terminal of the first transistor T1 in response to the first sensing control signal.

In some embodiments, as shown in FIG. 2, the pixel circuit 100 further includes a sensing connection sub-circuit 113. The sensing connection sub-circuit 113 is configured to receive a second sensing control signal, and is electrically connected to the control terminal of the driving sub-circuit. The sensing connection sub-circuit 113 is further electrically connected to the second sensing line SENL2. The sensing connection sub-circuit 113 is configured to electrically connect the control terminal of the driving sub-circuit 111 and the second sensing line SENL2. The sensing connection sub-circuit 113 has a first terminal, a second terminal and a control terminal. The control terminal of the sensing connection sub-circuit 113 is configured to receive the second sensing control signal, the first terminal of the sensing connection sub-circuit 113 is connected to the control terminal of the driving sub-circuit 111, and the second terminal of the sensing connection sub-circuit 113 is connected to the second sensing line SENL2.

For example, as shown in FIGS. 2 and 3, the sensing connection sub-circuit 113 includes a third transistor T3. A control terminal of the third transistor T3 is configured to receive the second sensing control signal, a first terminal of the third transistor T3 is electrically connected to the control terminal of the driving sub-circuit, and a second terminal of the third transistor T3 is electrically connected to the second sensing line SENL2. For example, as shown in FIG. 3, the first terminal of the third transistor T3 is configured to be connected to the first node N1, the second terminal of the third transistor T3 is configured to be connected to the second sensing line SENL2, and the control terminal of the third transistor T3 is configured to be connected to a second sensing control line Sn2, so as to receive the second sensing control signal provided from the second sensing control line Sn2. The third transistor T3 electrically connects the control terminal of the first transistor T1 and the second sensing line SENL2 in response to the second sensing control signal. In this case, the detection circuit 20 may obtain the voltage of the control terminal of the first transistor T1 through the second sensing line SENL2 and the third transistor T3 that is turned-on.

Figure 7:
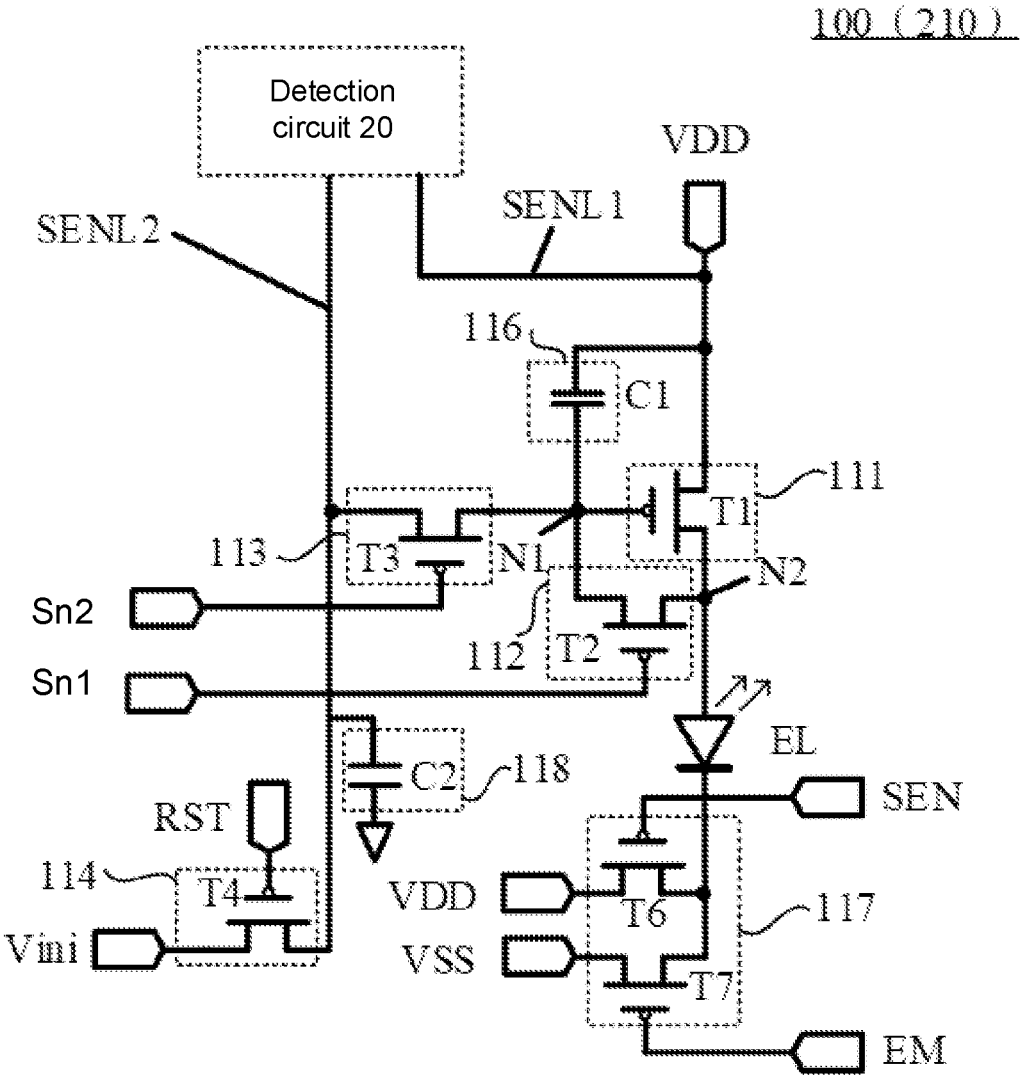
FIG. 7 is a structural diagram of yet another pixel circuit, in accordance with some embodiments of the present disclosure.

In some examples, as shown in FIG. 3, the first sensing control signal and the second sensing control signal are a same signal. That is, the first sensing control line Sn1 and the second sensing control line Sn2 are a same control line, which may be represented as Sn, and the second transistor T2 and the third transistor T3 receive a same sensing control signal. In some other examples, as shown in FIG. 7, the first sensing control signal and the second sensing control signal are different signals. That is, the first sensing control line Sn1 and the second sensing control line Sn2 are different control lines. In this case, the second sensing line SENL2 is also used as a data line, and a structure of the pixel circuit shown in FIG. 7 will be described later.

In some embodiments, as shown in FIG. 2, the pixel circuit 100 further includes a data writing sub-circuit 115. The data writing sub-circuit 115 is configured to receive a scan control signal, and is electrically connected to the control terminal of the driving sub-circuit 111. The data writing sub-circuit 115 is configured to write a data signal into the control terminal of the driving sub-circuit 111.

Figure 6:
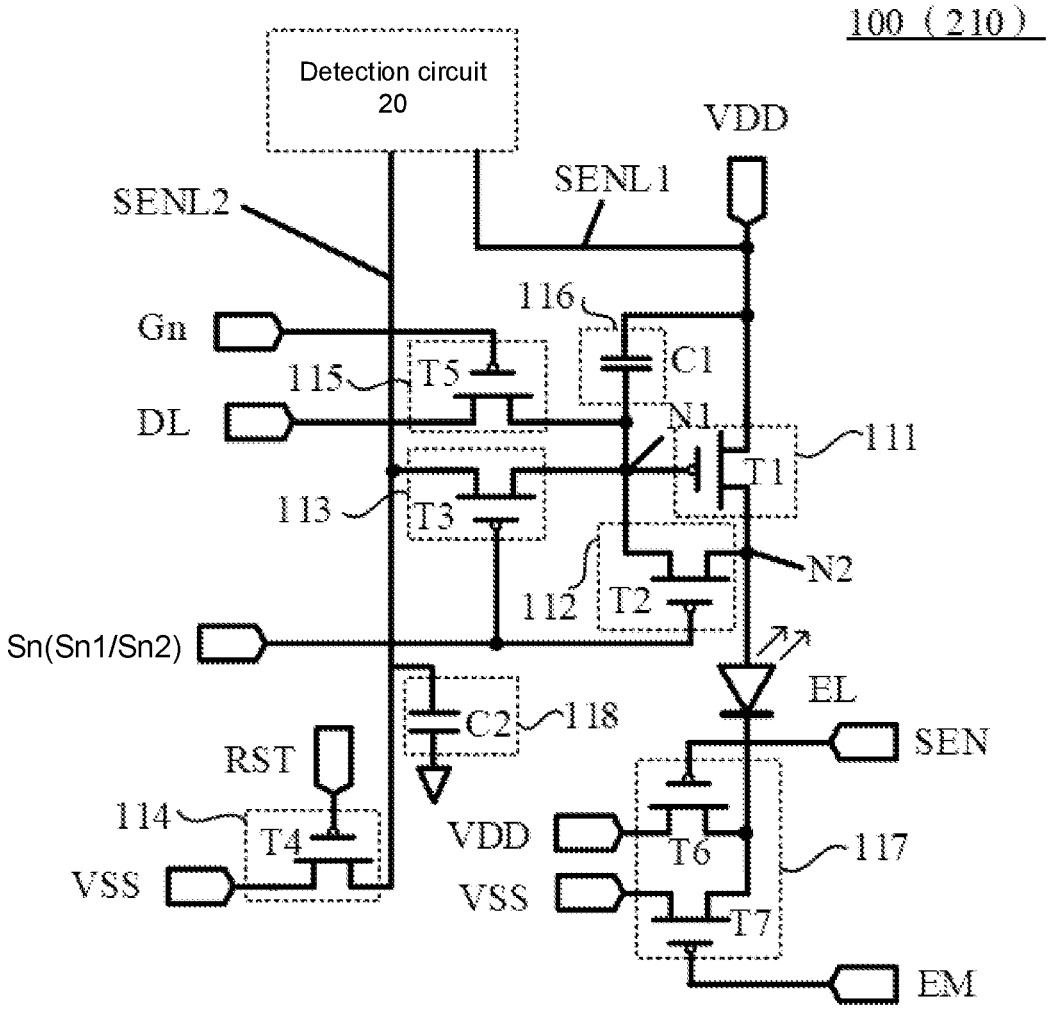
FIG. 6 is a structural diagram of yet another pixel circuit, in accordance with some embodiments of the present disclosure.

In some examples, as shown in FIGS. 2 and 3, the second sensing line SENL2 is also used as the data line, and the data writing sub-circuit 115 is further electrically connected to the second sensing line SENL2 to receive the data signal provided from the second sensing line SENL2, so that the data signal is written into the control terminal of the driving sub-circuit 111. In some other examples, as shown in FIG. 6, the pixel unit 210 further includes a data line DL. The data writing sub-circuit 115 is further electrically connected to the data line DL to receive a data signal provided from the data line DL, so that the data signal is written into the control terminal of the driving sub-circuit 111. A structure of the pixel circuit shown in FIG. 6 will be described later.

For example, as shown in FIGS. 2 and 3, the data writing sub-circuit 115 includes a fifth transistor T5. A control terminal of the fifth transistor T5 is configured to receive the scan control signal, a first terminal of the fifth transistor T5 is configured to be electrically connected to the second sensing line SENL2, and a second terminal of the fifth transistor T5 is electrically connected to the control terminal of the driving sub-circuit 111. The first terminal of the fifth transistor T5 is configured to be electrically connected to the second sensing line SENL2, and the second terminal of the fifth transistor T5 is configured to be connected to the first node N1, so as to receive the data signal provided from the second sensing line SENL2. The control terminal of the fifth transistor T5 is configured to be connected to a scan control line Gn, so as to receive a scan control signal provided from the scan control line Gn. The fifth transistor T5 is configured to write the data signal provided from the second sensing line SENL2 into the control terminal of the driving sub-circuit 111 in response to the scan control signal.

In FIG. 3, the second sensing line SENL2 is also used as the data line DL, and the detection circuit 20 is also used as a data driving circuit. That is, the detection circuit 20 functions to obtain voltages of the control terminal the first terminal of the first transistor T1 in a time-sharing manner, and to provide the data signal to the control terminal of the first transistor T1. For example, a duration of an active level (or a duration of an inactive level) of the scan control signal is not equal to a duration of an active level (or a duration of an inactive level) of the sensing control signal. Therefore, compensation effects and display effects of a display panel including the pixel circuit may be improved.

In some embodiments, as shown in FIG. 2, the pixel circuit 100 further includes a reset sub-circuit 114. The reset sub-circuit 114 is configured to receive a reset control signal and a reset signal, and is electrically connected to the second sensing line SENL2. The reset sub-circuit 114 is configured to receive the reset signal, so as to perform a reset operation on the control terminal of the driving sub-circuit 111 through the reset signal. In FIG. 2, the reset sub-circuit 114 has a first terminal, a second terminal and a control terminal. The second terminal of the reset sub-circuit 114 is electrically connected to the second sensing line SENL2, and the first terminal of the reset sub-circuit 114 is configured to receive the reset signal.

For example, as shown in FIGS. 2 and 3, the reset sub-circuit 114 includes a fourth transistor T4. A control terminal of the fourth transistor T4 is configured to receive the reset control signal, a first terminal of the fourth transistor T4 is configured to receive the reset signal, and a second terminal of the fourth transistor T4 is configured to be electrically connected to the second sensing line SENL2. The first terminal of the fourth transistor T4 is configured to be electrically connected to a reset signal line Vini, so as to receive the reset signal provided from the reset signal line Vini. The control terminal of the fourth transistor T4 is configured to be connected to a reset control line RST, so as to receive the reset control signal provided from the reset control line RST, and to perform the reset operation on the control terminal of the driving sub-circuit 111. In some examples, in a case where the pixel units are arranged in an array, a reset control line RST corresponding to pixel circuits in a row is a scan control line Gn corresponding to pixel circuits 100 in a previous row. The fourth transistor T4 is configured to write the reset signal provided from the reset signal line Vini into the control terminal of the driving sub-circuit 111 through the second sensing line SENL2 in response to the reset control signal.

In some embodiments, as shown in FIG. 2, the second terminal of the driving sub-circuit 111 is electrically connected to a first terminal of the light-emitting element 130, and the pixel circuit 100 further includes a voltage selection sub-circuit 117. The voltage selection sub-circuit 117 is configured to selectively connect a second terminal of the light-emitting element 130 to one of the first power supply terminal VDD and a second power supply terminal VSS. The second power supply terminal VSS is configured to provide a second power supply voltage, and the second power supply voltage is less than the first power supply voltage.

For example, as shown in FIG. 3, the voltage selection sub-circuit 117 includes a first power supply voltage supply sub-circuit 1171 and a second power supply voltage supply sub-circuit 1172. The first power supply voltage supply sub-circuit 1171 is configured to receive a third sensing control signal, and is electrically connected to the first power supply terminal VDD and the second terminal of the light-emitting element. The first power supply voltage supply sub-circuit 1171 is configured to electrically connect the second terminal of the light-emitting element 130 to the first power supply terminal VDD. The second power supply voltage supply sub-circuit 1172 is configured to receive a light-emitting control signal, and is electrically connected to the second power supply terminal VSS and the second terminal of the light-emitting element. The second power supply voltage supply sub-circuit 1172 is configured to electrically connect the second terminal of the light-emitting element 130 to the second power supply terminal VSS.

For example, as shown in FIGS. 2 and 3, the first power supply voltage supply sub-circuit 1171 includes a sixth transistor T6, and the second power supply voltage supply sub-circuit includes a seventh transistor T7.

For example, as shown in FIGS. 2 and 3, a first terminal of the sixth transistor T6 is configured to be electrically connected to the first power supply terminal VDD, a second terminal of the sixth transistor T6 is configured to be electrically connected to the second terminal of the light-emitting element 130, and a control terminal of the sixth transistor T6 is configured to receive the third sensing control signal. The control terminal of the sixth transistor T6 is configured to be connected to a third sensing control line SEN, so as to receive a third sensing control signal provided from the third sensing control line SEN. The sixth transistor T6 is configured to electrically connect the second terminal of the light-emitting element 130 to the first power terminal VDD in response to the third sensing control signal.

For example, the third sensing control signal is an active signal (e.g., Vgl) in a sensing phase, so that the sixth transistor T6 is turned on in the sensing phase. Therefore, the second terminal of the light-emitting element 130 is electrically connected to the first power supply terminal VDD in the sensing phase, which may prevent the light-emitting element 130 from emitting light in the sensing phase. In this way, a contrast of a display apparatus using the pixel circuit 100 may be improved, and energy consumption may be reduced.

For example, as shown in FIGS. 2 and 3, a first terminal of the seventh transistor T7 is configured to be electrically connected to the second power supply terminal VSS, a second terminal of the seventh transistor T7 is configured to be electrically connected to the second terminal of the light-emitting element 130, and a control terminal of the seventh transistor T7 is configured to receive the light-emitting control signal. The control terminal of the seventh transistor T7 is configured to be connected to a light-emitting control line EM, so as to receive the light-emitting control signal provided from the light-emitting control line EM. The seventh transistor T7 is configured to electrically connect the second terminal of the light-emitting element 130 to the second power supply terminal VSS in response to the light-emitting control signal.

For example, the light-emitting control signal is an inactive signal (e.g., Vgh) in the sensing phase, so that the seventh transistor T7 is turned off in the sensing phase. Therefore, the second terminal of the light-emitting element 130 is not connected to the second power supply terminal VSS in the sensing phase.

For example, in a light-emitting phase, the seventh transistor T7 electrically connects the second terminal of the light-emitting element 130 to the second power supply terminal VSS in response to the light-emitting control signal (for example, the light-emitting control signal is an active signal in the light-emitting phase). Therefore, the seventh transistor T7 is turned on in the light-emitting phase, and the second terminal of the light-emitting element 130 is electrically connected to the second power supply terminal VSS in the light-emitting phase. Thus, the light-emitting element 130 may emit light in the light-emitting phase.

It will be noted that, in some examples, the pixel circuit may not include the voltage selection sub-circuit 117. In this case, the pixel circuit may adopt a light-emitting control circuit, and the light-emitting control circuit is, for example, disposed between the driving transistor (i.e., the first transistor T1) and the first terminal of the light-emitting element, which will not be repeated.

For example, the first transistor T1 to the seventh transistor T7 may all be P-type transistors (for example, positive channel metal oxide semiconductor (PMOS) transistors, i.e., metal oxide semiconductor (MOS) transistors (with an n-type base, a p-channel) that transport current through the flow of holes). In this case, the first transistor T1 to the seventh transistor T7 are turned off when receiving a high level (a first level), and are turned on when receiving a low level (a second level, and the second level is less than the first level). That is, the high level (the first level) is an inactive level (i.e., a level that turns a transistor off), and the low level (the second level) is an active level (i.e., a level that turns a transistor on). It will be noted that, the first transistor T1 to the seventh transistor T7 are not limited to be implemented as the P-type transistors. According to actual application needs, one or more of the first transistor T1 to the seventh transistor T7 may also be implemented as N-type transistor(s).

In some embodiments, as shown in FIG. 2, the pixel circuit 100 further includes a second storage sub-circuit 118. For example, as shown in FIGS. 2 and 3, the second storage sub-circuit 118 includes a second storage capacitor C2. The second storage capacitor C2 is, for example, a parasitic capacitor of the second sensing line SENL2. That is, the second storage capacitor C2 does not exist independently.

For example, as shown in FIGS. 2 and 3, the light-emitting element 130 may be an organic light-emitting element EL. The organic light-emitting element EL may be, for example, an organic light-emitting diode (OLED), but the embodiments of the present disclosure are not limited thereto. For example, the light-emitting element 130 may also be an inorganic light-emitting element.

For example, the pixel circuit 100 shown in FIG. 3 may be implemented as a 4T1C pixel circuit. That is, the core circuit of the pixel circuit 100 shown in FIG. 3 is four transistors (the first transistor T1, the second transistor T2, the third transistor T3, and the fifth transistor T5) and one capacitor (the first storage capacitor C1). It will be noted that, in some examples, the fourth transistor T4, the sixth transistor T6, and the seventh transistor T7 may not be used as a part of the pixel circuit 100, which will not be repeated.

Some embodiments of the present disclosure further provide a detection method of the pixel circuit 100. The detection method of the pixel circuit 100 shown in FIG. 3 will be described below in combination with FIGS. 4, 5A and 5B.

Figure 4:
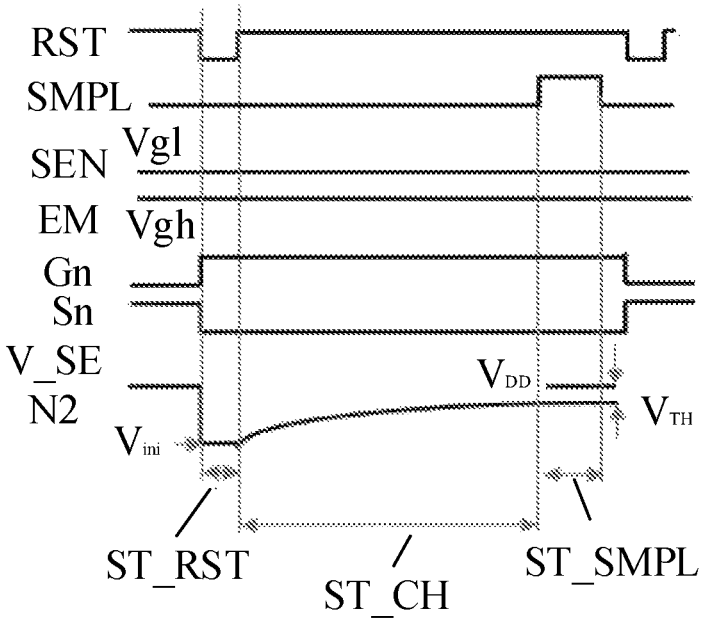
FIG. 4 is a timing diagram of driving the pixel circuit shown in FIG. 3.

FIG. 4 is a timing diagram of driving the pixel circuit 100 shown in FIG. 3. As shown in FIG. 4, a threshold detection of the pixel circuit 100 includes a reset phase ST_RST, a charging phase ST_CH and a sampling phase ST_SMPL. A following description is made in an example where the transistors included in the pixel circuit are all P-type transistors. In FIG. 4, a high level is an inactive level, and a low level is an active level.

Figure 5A:
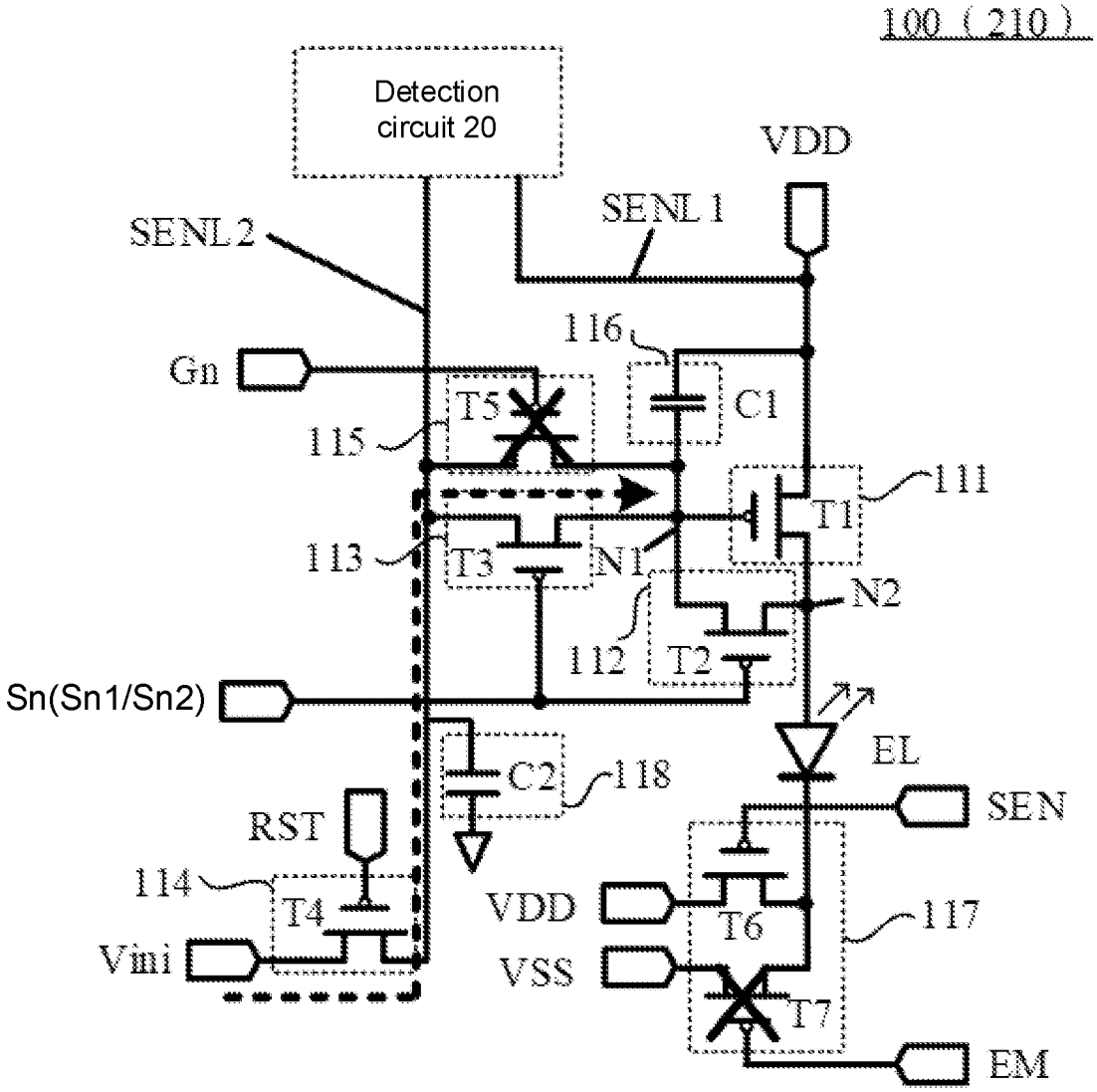
FIG. 5A is a signal flow diagram of the pixel circuit shown in FIG. 3 in a reset phase.

FIG. 5A is a signal flow diagram of the pixel circuit 100 shown in FIG. 3 in the reset phase ST_RST. As shown in FIG. 5A, in the reset phase ST_RST, the second transistor T2, the third transistor T3, the fourth transistor T4, and the sixth transistor T6 all receive the active level, and both the fifth transistor T5 and the seventh transistor T7 receive the inactive level. In this case, the second transistor T2, the third transistor T3, the fourth transistor T4, and the sixth transistor T6 are turned on, and the fifth transistor T5 and the seventh transistor T7 are turned off. The reset signal provided from the reset signal line Vini is written into the control terminal of the first transistor T1 through the turned-on fourth transistor T4, the second sensing line SENL2 and the turned-on third transistor T3. For example, the reset signal is a reset voltage, and the reset voltage is, for example, equal to zero volts.

Figure 5B:
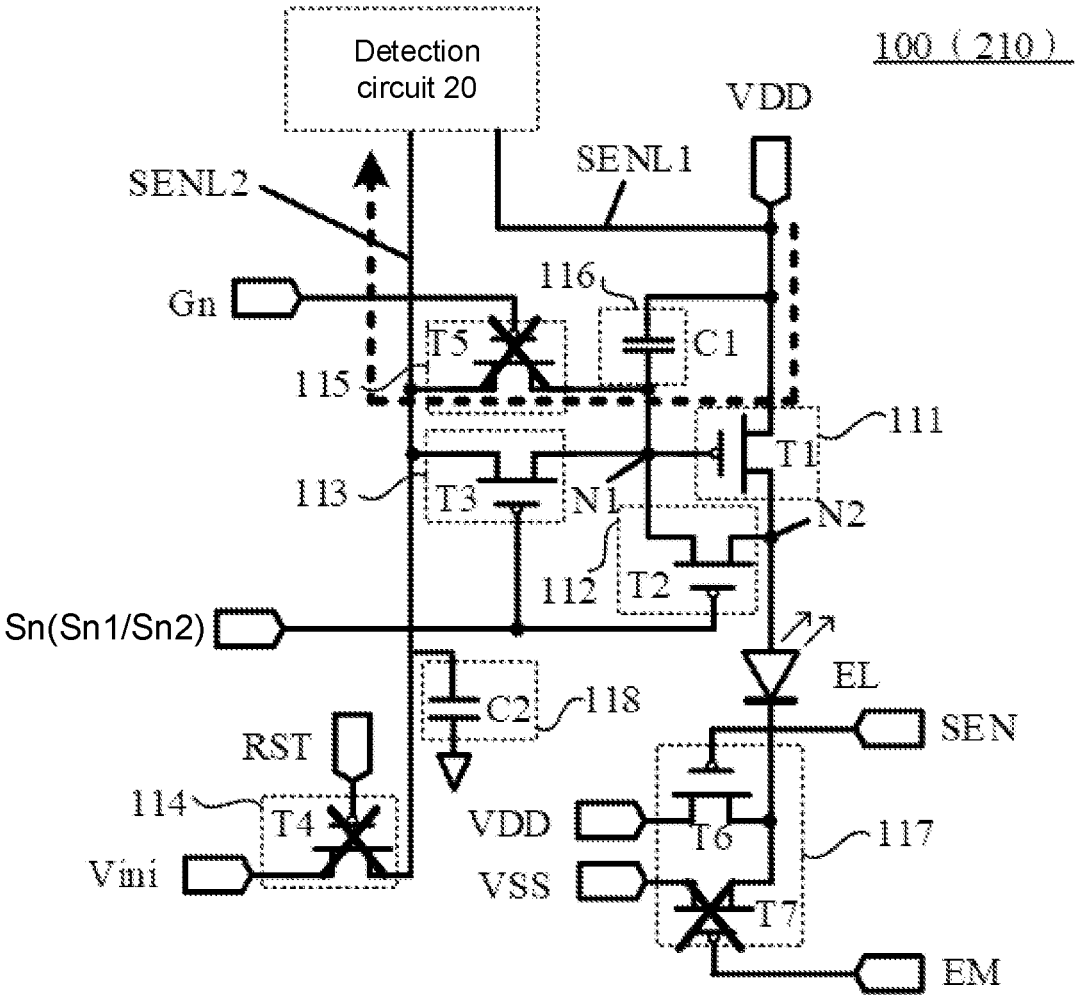
FIG. 5B is a signal flow diagram of the pixel circuit shown in FIG. 3 in a charging phase and a sampling phase.

FIG. 5B is a signal flow diagram of the pixel circuit 100 shown in FIG. 3 in the charging phase ST_CH and the sampling phase ST_SMPL. As shown in FIG. 5B, in the charging phase ST_CH and the sampling phase ST_SMPL, the second transistor T2, the third transistor T3 and the sixth transistor T6 all receive the active level, and the fourth transistor T4, the fifth transistor T5 and the seventh transistor T7 all receive the inactive level. In this case, the second transistor T2, the third transistor T3 and the sixth transistor T6 are turned on, and the fourth transistor T4, the fifth transistor T5 and the seventh transistor T7 are turned off.

For example, in the charging phase ST_CH, the first power supply terminal VDD charges the control terminal of the first transistor T1 (the first storage capacitor C1), until the voltage of the control terminal of the first transistor T1 is equal to or close to V_SEN1+Vth. Here, V_SEN1 is a first power supply voltage at a current moment, and Vth is the threshold voltage of the first transistor T1.

For example, in the sampling phase ST_SMPL (i.e., a duration during which the voltage of the control terminal of the first transistor T1 is equal to or close to V_SEN1+Vth), the detection circuit 20 may obtain a voltage V_SEN1 (i.e., the first power supply voltage at the current moment) of the first terminal of the first transistor T1 and the voltage V_SEN2 of the control terminal of the first transistor T1 at a specific moment (the sampling phase ST_SMPL) based on a sampling signal SMPL. For example, the detection circuit 20 may synchronously obtain the voltage V_SEN1 of the first terminal of the first transistor T1 and the voltage V_SEN2 of the control terminal of the first transistor T1 at a same moment, and the voltage V_SEN1 of the first terminal of the first transistor T1 and the voltage V_SEN2 of the control terminal of the first transistor T1 are, for example, analog signals.

For example, the detection circuit 20 may detect the voltage V_SEN1 of the first terminal of the driving transistor (i.e., the first transistor T1) through the first sensing line SENL1, and detect the voltage V_SEN2 of the control terminal of the driving transistor through the second sensing line SENL2. As shown in FIG. 3, the first terminal of the driving transistor (i.e., the first transistor T1) is configured to be electrically connected to the first power supply terminal VDD, so as to receive the first power supply voltage provided from the first power supply terminal VDD. The voltages of the first terminal and the control terminal of the driving transistor are configured to obtain the threshold voltage of the driving transistor in the pixel circuit.

Thus, the threshold voltage Vth of the driving transistor in the pixel circuit 100 may be obtained based on the voltage V_SEN1 of the first terminal of the driving transistor and the voltage V_SEN2 of the control terminal of the driving transistor. The threshold voltage Vth is equal to a difference value between the voltage V_SEN2 of the control terminal of the driving transistor and the voltage V_SEN1 of the first terminal of the driving transistor. That is, Vth=V_SEN2−V_SEN1. For example, since a threshold voltage of a P-type transistor is negative, in a case where the first transistor T1 is a P-type transistor, in the sampling phase ST_SMPL, the voltage V_SEN2 of the control terminal of the driving transistor is less than the voltage V_SEN1 of the first terminal.

For example, a corrected data signal Vdat_correct may be obtained by combining the threshold voltage Vth with a data signal to be applied to the pixel circuit 100, and the pixel circuit 100 may be driven based on the corrected data signal in a light-emitting phase (e.g., a display phase of a display panel 10 including the pixel circuit 100).

For example, a specific method of obtaining the corrected data signal Vdat_correct by combining the threshold voltage Vth with the data signal to be applied to the pixel circuit 100 may be set according to actual applications. In an example, gamma corrections on the pixel units in the display panel may be performed first, and corrected data signals of the pixel units in the display panel in a first frame may be obtained. Then, corrected data signals of the pixel units in a current frame are obtained based on the corrected data signals of the pixel units (i.e., the data signals applied to the pixel units) in the previous frame and a variation of the threshold voltage (or based on the corrected data signals of the pixel units in the previous frame, the variation of the threshold voltage, and a variation of a data voltage to be applied).

For example, in a case where a data voltage to be applied to the pixel circuit 100 in a current frame remains unchanged compared to a data voltage to be applied to the pixel circuit 100 in a previous frame, the corrected data signal (i.e., the corrected data signal in the previous frame) is equal to a sum of the data voltage Vdat_LF applied to the pixel circuit 100 in the previous frame and the variation ΔVth_dat of the threshold voltage. That is, Vdat_correct=Vdat_LF+ΔVth_dat. Here, the variation ΔVth_dat of the threshold voltage satisfies a following expression.

$$\Delta Vth_dat = Vth_CF - Vth_LF = (V_SEN2_CF - V_SEN1_CF) - (V_SEN2_LF - V_SEN1_LF).$$

Here, Vth_CF is the threshold voltage of the driving transistor in the current frame, Vth_LF is the threshold voltage of the driving transistor in the previous frame, V_SEN2_CF is the voltage of the control terminal of the driving transistor in the current frame, V_SEN1_CF is the voltage of the first terminal of the driving transistor in the current frame, V_SEN2_LF is the voltage of the control terminal of the driving transistor in the previous frame, and V_SEN1_LF is the voltage of the first terminal of the driving transistor in the previous frame.

For example, in a case where the data voltage to be applied to the pixel circuit 100 in the current frame is changed compared to the data voltage to be applied to the pixel circuit 100 in the previous frame, the corrected data signal is equal to a sum of the data voltage Vdat_LF (i.e., the corrected data signal in the previous frame) applied to the pixel circuit 100 in the previous frame, a variation ΔVdat of the data voltage to be applied to the pixel circuit 100, and the variation ΔVth_dat of the threshold voltage. That is, Vdat_correct=Vdat_LF+ΔVdat+ΔVth_dat. Here, the variation ΔVdat of the data voltage to be applied to the pixel circuit 100 is equal to a difference value between the data voltage Vdat_CFI to be applied to the pixel circuit 100 in the current frame and the data voltage Vdat_LFI to be applied to the pixel circuit 100 in the previous frame. That is, ΔVdat=Vdat_CFI−Vdat_LFI. Therefore, Vdat_correct=Vdat_LF+Vdat_CFI−Vdat_LF1+Vth_CF−Vth_LF.

In the pixel unit 210 in some embodiments of the present disclosure, by providing the first sensing line SENL1 and the second sensing line SENL2, and synchronously obtaining the voltage V_SEN1 of the first terminal of the first transistor T1 and the voltage V_SEN2 of the control terminal of the first transistor T1 by using the first sensing line SENL1 and the second sensing line SENL2, an adverse effect of a fluctuation of the first power supply voltage output from the first power supply terminal VDD on the accuracy of the threshold detection may be avoided. Thus, the accuracy of the threshold voltage Vth of the first transistor T1 and the corrected data signal may be improved, and the display effects of both the display panel and the display apparatus including the pixel circuits may be improved.

Figure 5C:
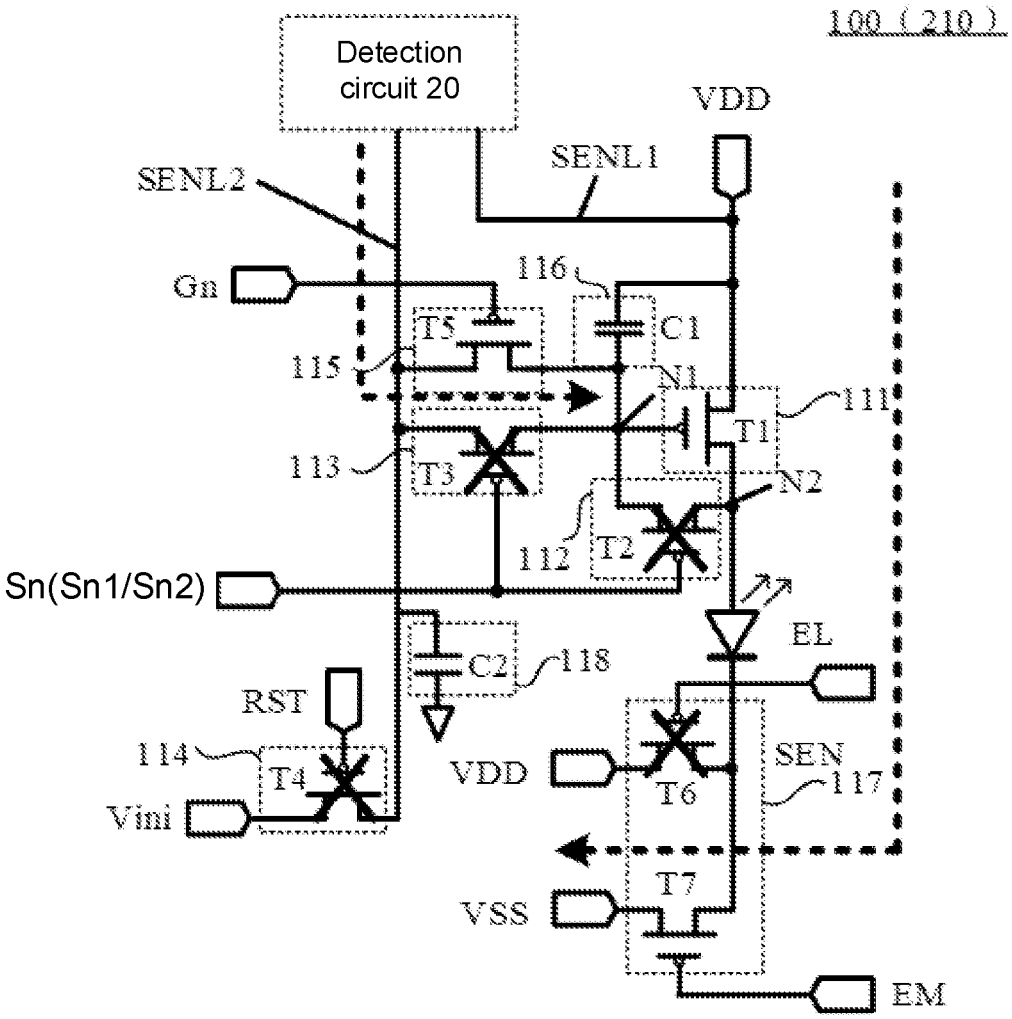
FIG. 5C is a signal flow diagram of the pixel circuit shown in FIG. 3 in a light-emitting phase.

FIG. 5C is a signal flow diagram of the pixel circuit 100 shown in FIG. 3 in the light-emitting phase. For example, as shown in FIG. 5C, in the light-emitting phase, the second transistor T2, the third transistor T3, the fourth transistor T4, and the sixth transistor T6 all receive the inactive level, and both the fifth transistor T5 and the seventh transistor T7 receive the active level. In this case, the second transistor T2, the third transistor T3, the fourth transistor T4, and the sixth transistor T6 are turned off, and the fifth transistor T5 and the seventh transistor T7 are turned on.

For example, as shown in FIG. 5C, in the light-emitting phase, the detection circuit 20 writes the corrected data signal into the control terminal of the first transistor T1 through the turned-on fifth transistor T5. The turned-on seventh transistor T7 connects the second terminal of the light-emitting element 130 to the second power supply terminal VSS. In this case, the light-emitting element 130 emits light based on the corrected data signal applied to the control terminal of the first transistor T1.

It will be noted that, the specific structure of the pixel circuit 100 in the pixel unit 210 in some embodiments of the present disclosure is not limited to the pixel circuit 100 shown in FIG. 3. According to actual application needs, the pixel circuit 100 in some embodiments of the present disclosure may also be implemented as the pixel circuit 100 shown in FIG. 6, the pixel circuit 100 shown in FIG. 7, the pixel circuit 100 shown in FIG. 8, or other applicable pixel circuits. A following description is made with reference to FIGS. 6 to 8.

FIG. 6 is another example of the pixel circuit 100 in some embodiments of the present disclosure. The pixel circuit 100 shown in FIG. 6 is similar to the pixel circuit 100 shown in FIG. 3, and thus only the differences between the two are described here, and the similarities will not be repeated.

As shown in FIGS. 3 and 6, the differences between the pixel circuit 100 shown in FIG. 6 and the pixel circuit 100 shown in FIG. 3 include: (1) the first terminal of the fourth transistor T4 in the pixel circuit 100 shown in FIG. 6 being connected to the second power supply terminal VSS, i.e., the second power supply voltage in the pixel circuit 100 shown in FIG. 6 being used as the reset signal, so that the reset signal line is not required to be provided in a display apparatus including the pixel circuit 100 shown in FIG. 6; (2) The first terminal of the fifth transistor T5 in the pixel circuit 100 shown in FIG. 6 being configured to be connected to the data line DL. In this case, the data line DL and the second sensing line SENL2 are different lines, and the detection circuit 20 does not need to have a function of providing the data signal.

FIG. 7 is another example of the pixel circuit 100 in some embodiments of the present disclosure. The pixel circuit 100 shown in FIG. 7 is similar to the pixel circuit 100 shown in FIG. 3, and thus only the difference between the two is described here, and the similarities will not be repeated.

As shown in FIGS. 3 and 7, the difference between the pixel circuit 100 shown in FIG. 7 and the pixel circuit 100 shown in FIG. 3 includes: the pixel circuit 100 shown in FIG. 7 not including the data writing sub-circuit 115, i.e., the pixel circuit 100 not including the fifth transistor T5, and the first sensing control line Sn1 electrically connected to the control terminal of the second transistor T2 in the pixel circuit 100 shown in FIG. 7 and the second sensing control line Sn2 electrically connected to the control terminal of the third transistor T3 being different control lines (i.e., Sn1 and Sn2 being different). In this case, the function of the data writing sub-circuit 115 is implemented by the third transistor T3. That is, the sensing connection sub-circuit 113 is also used as the data writing sub-circuit 115. In this case, the second sensing line SENL2 is also used as the data line DL, so as to provide the data signal.

For example, by electrically connecting the control terminal of the second transistor T2 and the control terminal of the third transistor T3 to different sensing control lines (Sn1 and Sn2), it may be ensured that the second transistor T2 (the compensation connection sub-circuit 112) is turned off in the light-emitting phase, so that the third transistor T3 (the sensing connection sub-circuit 113) is turned on in the light-emitting phase, so as to write the data signal provided from the second sensing line SENL2 into the control terminal of the driving sub-circuit 111. For example, the pixel circuit 100 shown in FIG. 7 may be implemented as a 3T1C pixel circuit 100. That is, the core circuit of the pixel circuit 100 shown in FIG. 7 is of three transistors (the first transistor T1, the second transistor T2, and the third transistor T3) and one capacitor (the first storage capacitor C1).

Figure 8:
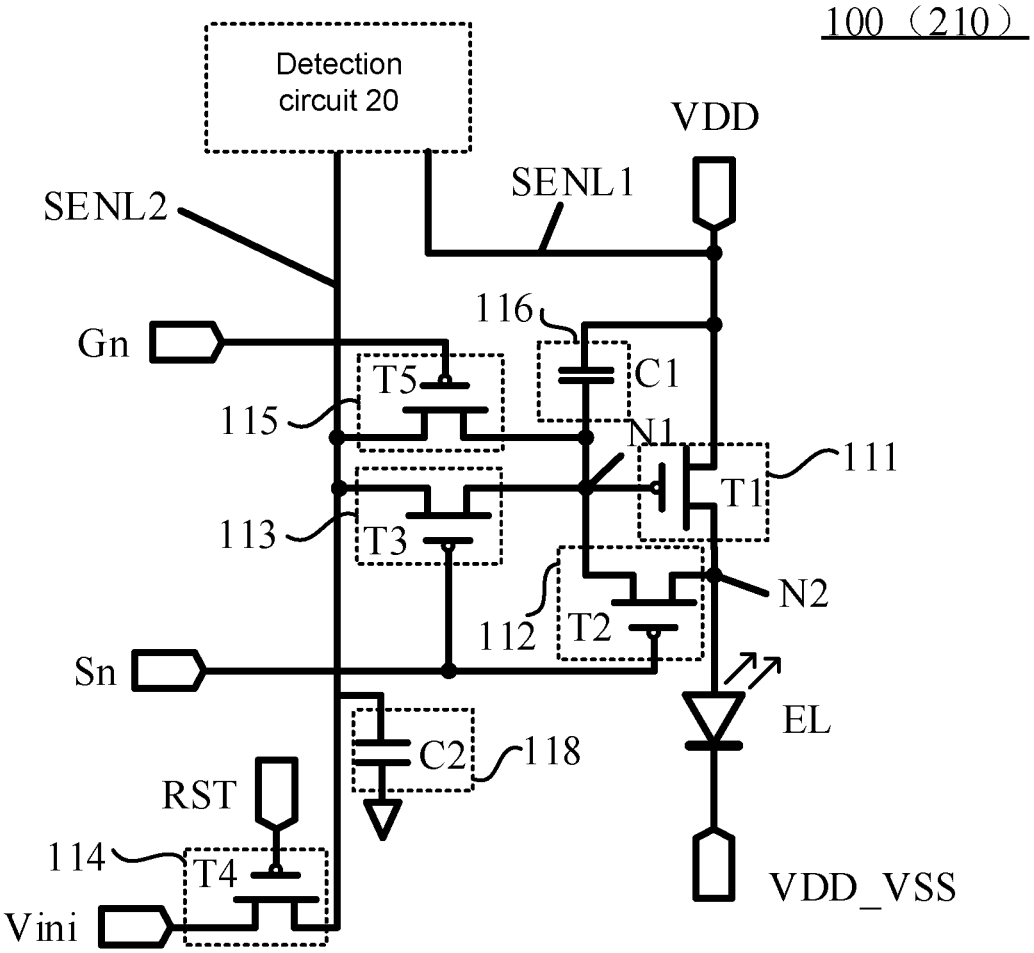
FIG. 8 is a structural diagram of yet another pixel circuit, in accordance with some embodiments of the present disclosure.

FIG. 8 is yet another example of the pixel circuit 100 in some embodiments of the present disclosure. The pixel circuit 100 shown in FIG. 8 is similar to the pixel circuit 100 shown in FIG. 3, and thus only the difference between the two is described here, and the similarities will not be repeated.

As shown in FIGS. 3 and 8, the difference between the pixel circuit 100 shown in FIG. 8 and the pixel circuit 100 shown in FIG. 3 includes: the pixel circuit 100 shown in FIG. 8 not including the voltage selection sub-circuit 117. In this case, the second terminal of the driving sub-circuit 111 is electrically connected to the first terminal of the light-emitting element 130, and the second terminal of the light-emitting element 130 is electrically connected (or connected) to a variable power supply terminal VDD_VSS. The variable power supply terminal VDD_VSS is configured to provide the first power supply voltage in the sensing phase, and is configured to provide a second power supply voltage in the light-emitting phase. The second power supply voltage is less than the first power supply voltage.

It will be noted that, the pixel circuit 100 shown in FIG. 3 may have any one or any combination of the above four differences (i.e., the two differences in the pixel circuit 100 shown in FIG. 6, the difference in the pixel circuit 100 shown in FIG. 7, and the difference in the pixel circuit 100 shown in FIG. 8). For example, a pixel circuit including any one or any combination of the above four differences may be used as the pixel circuit 100 shown in FIG. 2.

Figure 9:
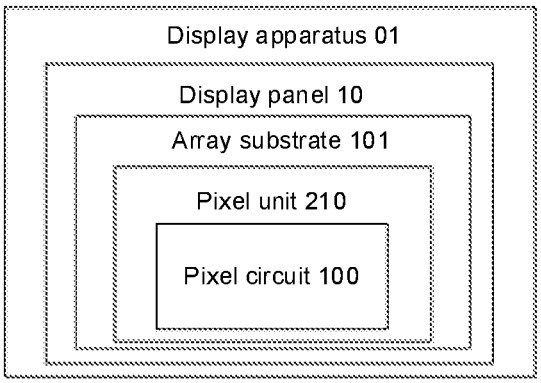
FIG. 9 is a block diagram exemplarily showing an array substrate, a display panel and a display apparatus, in accordance with some embodiments of the present disclosure.

At least one embodiment of the present disclosure further provides an array substrate 101, a display panel 10, and a display apparatus 01. FIG. 9 is a block diagram exemplarily showing the array substrate 101, the display panel 10 and the display apparatus 01 in the at least one embodiment of the present disclosure. The array substrate 101 in the at least one embodiment of the present disclosure includes any pixel unit 210 in at least one embodiment of the present disclosure. The display panel 10 in the at least one embodiment of the present disclosure includes any array substrate 101 in at least one embodiment of the present disclosure. The display apparatus 01 in the at least one embodiment of the present disclosure includes any display panel 10 in at least one embodiment of the present disclosure.

As shown in FIGS. 10 to 14, the array substrate 101 in some embodiments of the present disclosure includes a plurality of pixel units 210 arranged in an array. The array substrate 101 includes a plurality of gate lines GL and a plurality of data lines DL, and the gate line GL and the data line DL cross each other. For example, the plurality of gate lines GL extend in a row direction, the plurality of data lines DL extend in a column direction, and the plurality of gate lines GL and the plurality of data lines DL define the plurality of pixel units 210 arranged in the array. Each of the plurality of pixel units 210 includes any pixel circuit 100 in at least one embodiment of the present disclosure.

As shown in FIGS. 10 to 14, the array substrate 101 in some embodiments of the present disclosure further includes at least one first sensing line SENL1 and a plurality of second sensing lines SENL2. It will be noted that, in some examples of the present disclosure, the pixel unit 210 includes the first sensing line SENL1 and the second sensing line SENL2, which means that the detection circuit 20 obtains the sensing signals of the pixel circuit 100 included in the pixel unit 210 through the first sensing line SENL1 and the second sensing line SENL2, without limiting that the first sensing line SENL1 or the second sensing line SENL2 is completely located in the pixel unit 210. For example, a part of the first sensing line SENL1 or the second sensing line SENL2 may be located in the pixel unit 210, or the entire sensing line may also be located outside a corresponding pixel unit 210.

In some examples, at least of the plurality of pixel units 210 in the array substrate 101 may share a same first sensing line SENL1. That is, the pixel circuits 100 in the at least two pixel units 210 are electrically connected to the same first sensing line SENL1. In this case, the number of first sensing lines SENL1 and an area occupied by the first sensing lines SENL1 may be reduced, thereby ensuring or improving the resolution of the display panel 10. An exemplary description is made with reference to FIGS. 10 to 15.

Figure 10:
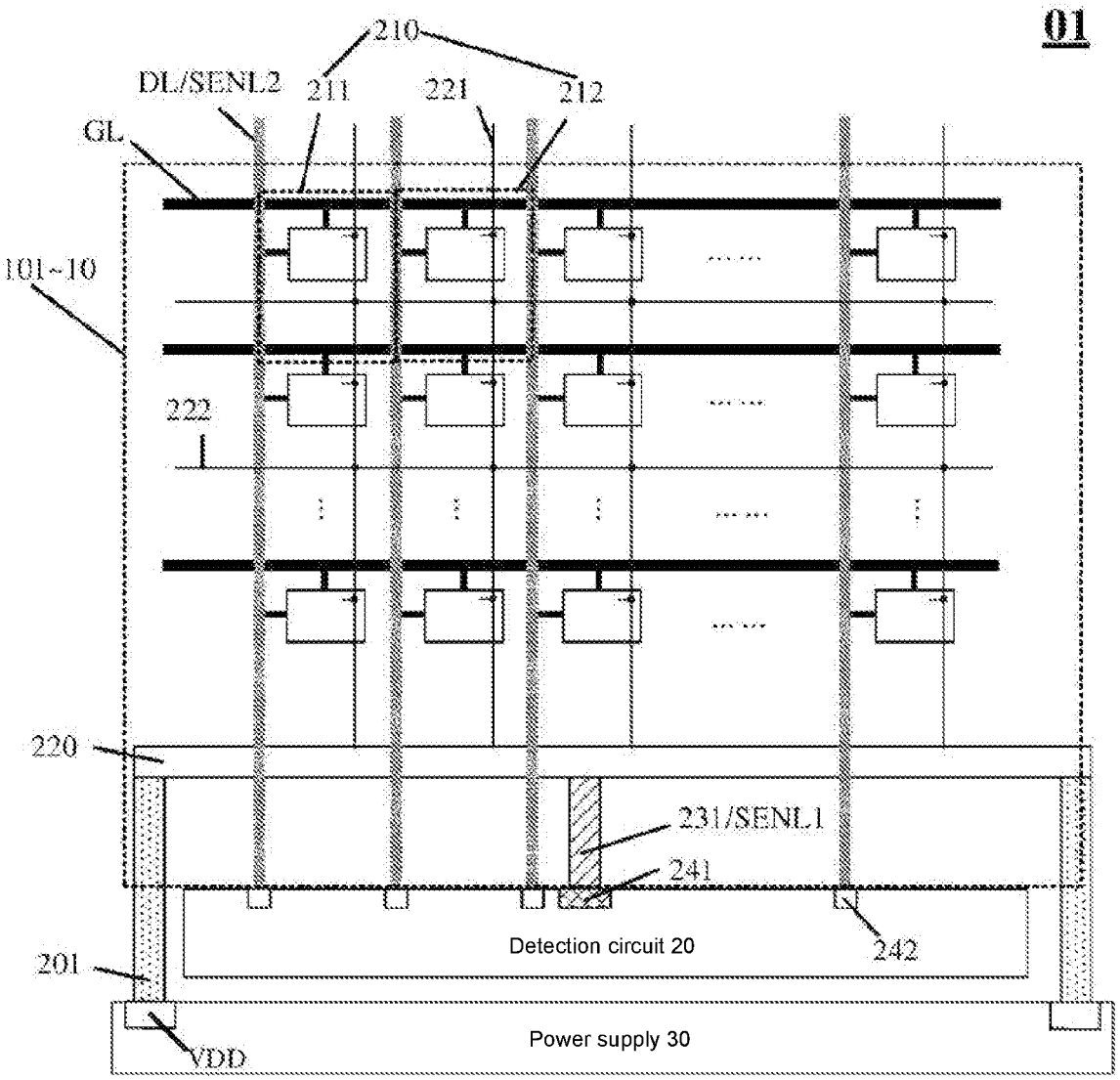
FIG. 10 is a structural diagram of an array substrate, a display panel and a display apparatus, in accordance with some embodiments of the present disclosure.

FIG. 10 is an example of the array substrate 101, the display panel 10, and the display apparatus 01 shown in FIG. 9. As shown in FIG. 10, the plurality of data lines DL are also used as the plurality of second sensing lines SENL2. For example, pixel units 210 located in a same column share a same second sensing line SENL2.

For example, as shown in FIG. 10, all of the pixel units 210 in the array substrate 101 share a same first sensing line SENL1. For example, as shown in FIG. 10, the array substrate 101 includes one first sensing line SENL1. The first sensing line SENL1 is a common sensing line 231, and all of the pixel units 210 share the first sensing line SENL1 (the common sensing line 231). That is, the pixel circuits 100 included in the pixel units 210 are electrically connected to the first sensing line SENL1. For example, the plurality of pixel units 210 include first pixel units 211 and second pixel units 212, and the first pixel units 211 and the second pixel units 212 share the same first sensing line SENL1.

In some embodiments, as shown in FIG. 10, the array substrate 101 further includes at least one first power bus 220. The pixel circuits 100 (the first terminals of the first transistors T1 in the pixel circuits 100) in all of the pixel units 210 in the array substrate 101 are connected to the at least one first power bus 220.

As shown in FIG. 10, the array substrate 101 further includes a plurality of first power lines 221 and a plurality of second power lines 222. An extending direction of the plurality of first power lines 221 is the same as an extending direction of the plurality of data lines DL, and the plurality of first power lines 221 are all electrically connected (for example, directly electrically connected) to the first power bus 220. An extending direction of the plurality of second power lines 222 is the same as an extending direction of the plurality of gate lines GL, and the plurality of second power lines 222 are electrically connected (for example, directly connected) to the first power lines 221 that intersect with the plurality of second power lines 222.

As shown in FIG. 10, the display apparatus 01 in some embodiments of the present disclosure further includes a power supply 30 and a detection circuit 20. As shown in FIG. 10, the power supply includes a first power supply terminal VDD and a second power supply terminal VSS (not shown in FIG. 10, see FIG. 12). The first power supply terminal VDD provides a first power supply voltage, and the second power supply terminal VSS provides a second power supply voltage. The first power bus 220 is configured to be electrically connected to the first power supply terminal VDD. Thus, the first power bus 220 may provide the first power voltage to the plurality of pixel units 210. For example, the power supply 30 may be implemented as a circuit board (e.g., a flexible circuit board).

In some examples, as shown in FIG. 10, the display apparatus 01 further includes at least one power supply line 201. The power supply line(s) 201 are located between the first power terminal VDD and the first power bus 220, and extend from the first power supply terminal VDD to the first power bus 220, so that the first power bus 220 is electrically connected to the first power supply terminal VDD. For example, as shown in FIG. 10, the display apparatus 01 includes two power supply lines 201, and the two power supply lines 201 are connected to two ends of the first power bus 220, respectively. For example, the display apparatus 01 may further include the power supply lines 201 of other suitable number, which will not be repeated here.

In some embodiments, as shown in FIG. 10, the detection circuit 20 includes at least one first signal terminal 241 and a plurality of second signal terminals 242. The at least one first signal terminal 241 is configured to be electrically connected to the at least one first sensing line SENL1, and each of the plurality of second signal terminals 242 is configured to be electrically connected to one second sensing line SENL2.

For example, as shown in FIG. 10, the number of second signal terminals 242 is equal to the number of second sensing lines SENL2, and the plurality of data lines DL (i.e., the second sensing lines SENL2) in the display panel 10 are connected to the plurality of second signal terminals 242 in the detection circuit 20. For example, the detection circuit 20 may be implemented as a chip (e.g., a semiconductor chip and IC) or a field programmable gate array (FPGA) circuit. For example, the detection circuit 20 further has a function of providing the data signal.

As shown in FIG. 10, the common sensing line 231 (e.g., two ends of the common sensing line 231) is configured to be electrically connected to the first power bus 220 and the first signal terminal 241. For example, as shown in FIG. 10, the common sensing line 231 is located between the first power bus 220 and the first signal terminal 241, and extends from the first power bus 220 to the first signal terminal 241. For example, as shown in FIG. 10, the number of the first signal terminal(s) 241 is equal to the number of the first sensing line(s) SENL1 (i.e., the number of the common sensing line(s) 231).

For example, the first power bus 220 includes a resistance midpoint, and the common sensing line 231 is connected to the resistance midpoint of the first power bus 220. For example, the resistance midpoint of the first power bus 220 may be a physical midpoint of the first power bus 220.

It will be noted that, the array substrate 101, the display panel 10 and the display apparatus 01 are not limited to including one common sensing line 231. According to actual application needs, the display apparatus 01 may also include two common sensing lines 231, which will be exemplarily described below with reference to FIGS. 11 and 12.

Figure 11:
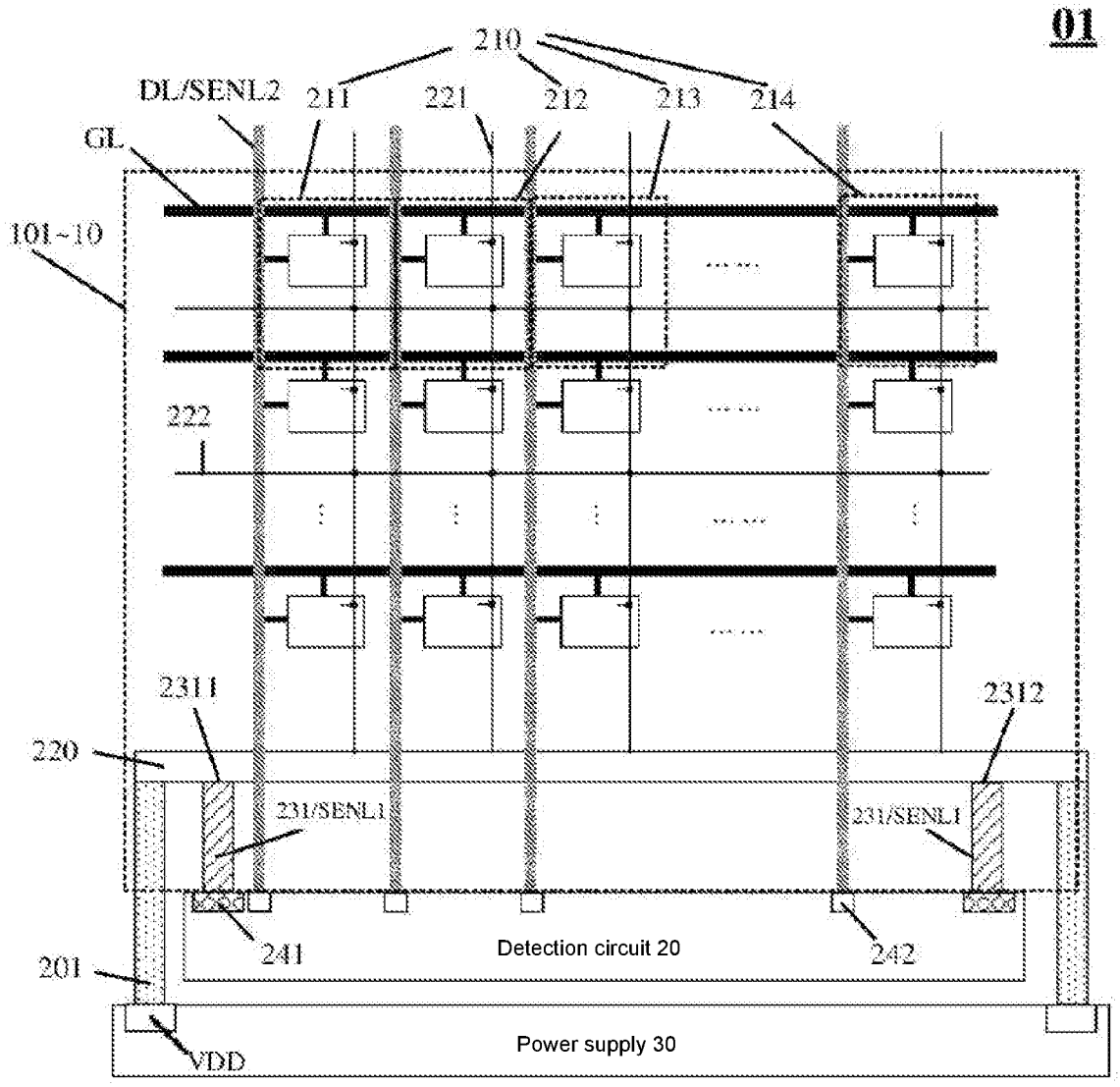
FIG. 11 is another structural diagram of an array substrate, a display panel and a display apparatus, in accordance with some embodiments of the present disclosure.
Figure 12:
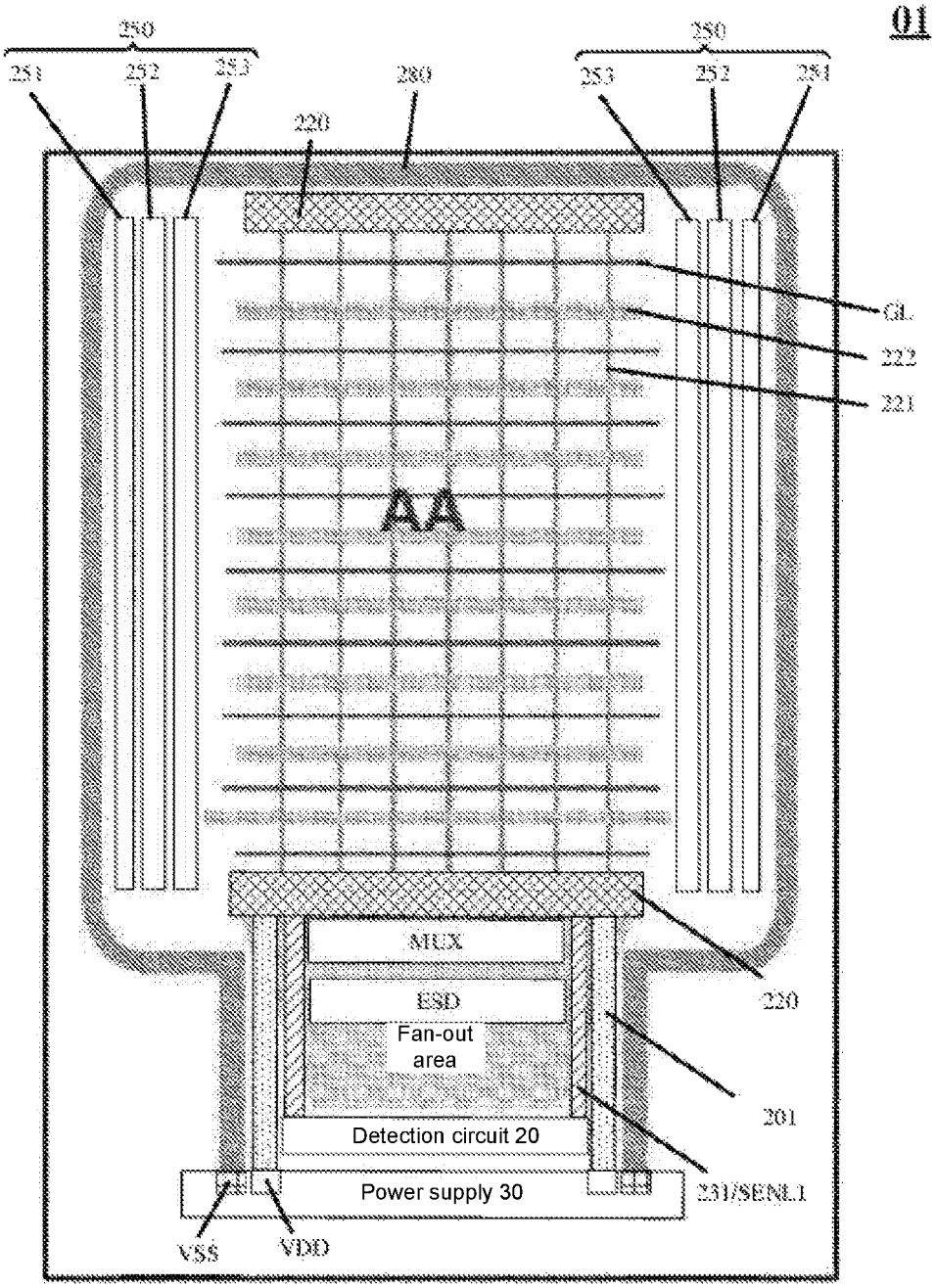
FIG. 12 is yet another structural diagram of an array substrate, a display panel and a display apparatus, in accordance with some embodiments of the present disclosure.

FIG. 11 is a structural diagram of another example of the array substrate 101, the display panel 10 and the display apparatus 01 in some embodiments of the present disclosure. FIG. 12 is a structural diagram of yet another example of the array substrate 101, the display panel 10 and the display apparatus 01 in some embodiments of the present disclosure. The array substrate 101, the display panel 10 and the display apparatus 01 shown in FIGS. 11 and 12 are similar to the array substrate 101, the display panel 10 and the display apparatus 01 shown in FIG. 10. Only the differences between the two are described here, and the similarities will not be repeated.

In some embodiments, as shown in FIG. 11, all of the pixel units 210 in the array substrate 101 share two first sensing lines SENL1. For example, as shown in FIG. 11, the array substrate 101 includes two first sensing lines SENL1, the two first sensing lines SENL1 are two common sensing lines 231, and the two common sensing lines 231 are connected to a first position 2311 and a second position 2312 of the first power bus 220, respectively. Some of the plurality of pixel units 210 share one first sensing line SENL1, and some of the plurality of pixel units 210 share another first sensing line SENL1.

For example, as shown in FIG. 11, the first position 2311 and the second position 2312 are proximate to the power supply lines 201 (or the two ends of the first power bus 220), respectively, and the first position 2311 and the second position 2312 are located at a side of an outermost data line DL in the plurality of data lines DL proximate to a corresponding power supply line 201. For example, the first position 2311 and the second position 2312 are a ⅕ resistance point and a ⅘ resistance point between a first end and a second end of the first power bus 220, respectively. For another example, the first position 2311 and the second position 2312 are a ⅓ resistance point and a ⅔ resistance point between the first end and the second end of the first power bus 220, respectively. For yet another example, the first position 2311 and the second position 2312 are a ⅐ resistance point and a ⅙ resistance point between the first end and the second end of the first power bus 220, respectively.

In the array substrate 101, by providing the two common sensing lines 231, a voltage value at the first position 2311 and a voltage value at the second position 2312 of the first power bus 220 may be detected and obtained. In this case, the voltage of the first terminal of the driving sub-circuit 111 in the pixel circuit 100 included in the pixel unit 210 is equal to an average value of the voltage value at the first position 2311 and the voltage value at the second position 2312. In this way, the accuracy of the threshold detection of the pixel circuit 100 may be improved by providing the two common sensing lines 231.

For example, as shown in FIG. 11, the plurality of pixel units 210 further include third pixel units 213 and fourth pixel units 214. The first pixel units 211 and the second pixel units 212 share one first sensing line SENL1 (e.g., the common sensing line 231 on the left), and the third pixel units 213 and the fourth pixel units 214 share another first sensing line SENL1 (e.g., the common sensing line 231 on the right). The two common sensing lines 231 are respectively connected to different positions (for example, respectively connected to the first position and the second position) of the first power bus 220. For example, the first pixel units 211, the second pixel units 212, the third pixel units 213 and the fourth pixel units 214 are electrically connected to each other through the first power bus 220.

It will be noted that, the array substrate 101, the display panel 10 and the display apparatus 01 shown in FIG. 11 are not limited to providing two common sensing lines 231. According to actual application needs, the array substrate 101, the display panel 10 and the display apparatus 01 shown in FIG. 11 may also be provided with the common sensing lines 231 of other suitable number.

In some embodiments, as shown in FIG. 12, the display panel 10 includes an array area (AA) and a peripheral area, and the array area includes the plurality of pixel units 210.

For example, as shown in FIG. 12, the array substrate 101 may include two first power buses 220. The two first power buses 220 are disposed on two sides of the first power lines 221, and are connected to two ends of the first power line 221, respectively.

For example, as shown in FIG. 12, the display apparatus 01 may further include two groups of gate driving circuits 250, and each group of gate driving circuit 250 includes a first gate driving circuit 251, a second gate driving circuit 252 and a reset voltage supply circuit 253 that are sequentially arranged in an extending direction of the gate lines GL. For example, as shown in FIG. 12, the two groups of gate driving circuits 250 are disposed at two sides of the array area in the extending direction of the gate lines GL. For example, both the first gate driving circuit 251 and the second gate driving circuit 252 may be implemented as a gate drive integration on the array substrate (GOA). For example, the display apparatus 01 is not limited to adopting a double-sided driving shown in FIG. 12, and the display apparatus 01 may also adopt a single-sided to driving.

For example, the first gate driving circuit 251 is electrically connected to the light-emitting control line EM (or the control terminal of the seventh transistor T7) in the pixel circuit 100, so as to provide the light-emitting control signal to the pixel circuit 100. For example, the second gate driving circuit 252 is electrically connected to the scan control line Gn (or the control terminal of the fifth transistor T5) in the pixel circuit 100, so as to provide the scan control signal to the pixel circuit 100. For example, the reset voltage supply circuit 253 is connected to the reset sub-circuit 114 (the first terminal of the fourth transistor T4) in the pixel circuit 100, so as to provide the reset signal to the pixel circuit 100.

For example, as shown in FIG. 12, the display apparatus 01 may further include a second power bus 280. The second power bus 280 extends along the peripheral area of the display apparatus 01 (around the array area and the two groups of gate driving circuits 250), and is connected to the second power supply terminal VSS of the power supply 30, so as to provide the second power supply voltage provided from the second power supply terminal VSS to the pixel circuits 100 in the pixel units 210 in the display apparatus 01.

For example, as shown in FIG. 12, the display apparatus 01 may further include an electrostatic discharge structure ESD, an N-to-1 selection circuit MUX. For example, the N-to-1 selection circuit MUX includes N input terminals and an output terminal, and the N input terminals of the N-to-1 selection circuit MUX are respectively connected to N data lines DL in the display panel 10, so as to reduce the number of the second signal terminals 242 of the detection circuit 20.

It will be noted that, when the detection circuit 20 is used for obtaining a detection signal, the array area may be scanned row by row. In this case, pixel circuits 100 in pixel units in different rows are connected to different scan control lines and different sensing control lines. For example, in a case the array area is scanned row by row, differences among the first power supply voltages received by a plurality of pixel units 210 are small. Thus, the accuracy of the threshold detection may be further improved.

Figure 13:
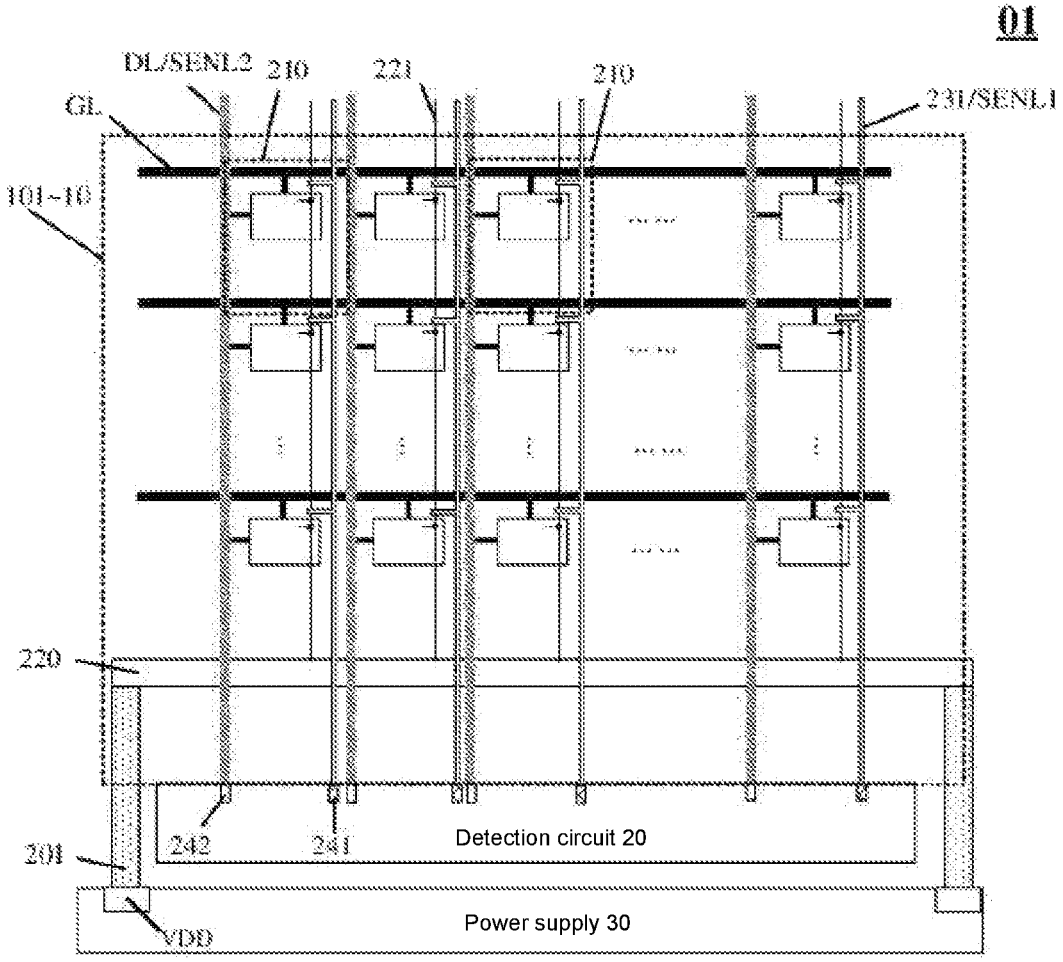
FIG. 13 is yet another structural diagram of an array substrate, a display panel and a display apparatus, in accordance with some embodiments of the present disclosure.

FIG. 13 is a structural diagram of yet another example of the array substrate 101, the display panel 10 and the display apparatus 01 in some embodiments of the present disclosure. The display panel 10 and the display apparatus 01 shown in FIG. 13 are similar to the display panel 10 and the display apparatus 01 shown in FIG. 11, and thus only the differences between the two are described here, and the similarities will not be repeated.

For example, the array substrate 101, the display panel 10 and the display apparatus 01 shown in FIG. 13 have following differences from the array substrate 101, the display panel 10 and the display apparatus 01 shown in FIG. 11. (1) The array substrate 101 shown in FIG. 13 does not include the second power line 222, each column of pixel units 210 is connected to a same first power line 221, and the plurality of first power lines 221 are all connected to the first power bus 220. (2) The array substrate 101 shown in FIG. 13 includes a plurality of (M, M is equal to the number of columns of the pixel units 210) first sensing lines SENL1, each first sensing line SENL1 is the common sensing line 231, and each column of pixel units 210 shares a same first sensing line SENL1. That is, pixel circuits 100 included in each column of pixel units 210 are electrically connected to the same first sensing line SENL1. (3) The detection circuit 20 includes a plurality of (e.g., M) first signal terminals 241, and each of the plurality of common sensing lines 231 is connected to one of the plurality of first signal terminals 241. For example, by making each column of pixel units 210 share the same common sensing line 231, the accuracy of the threshold detection may be further improved.

Figure 14:
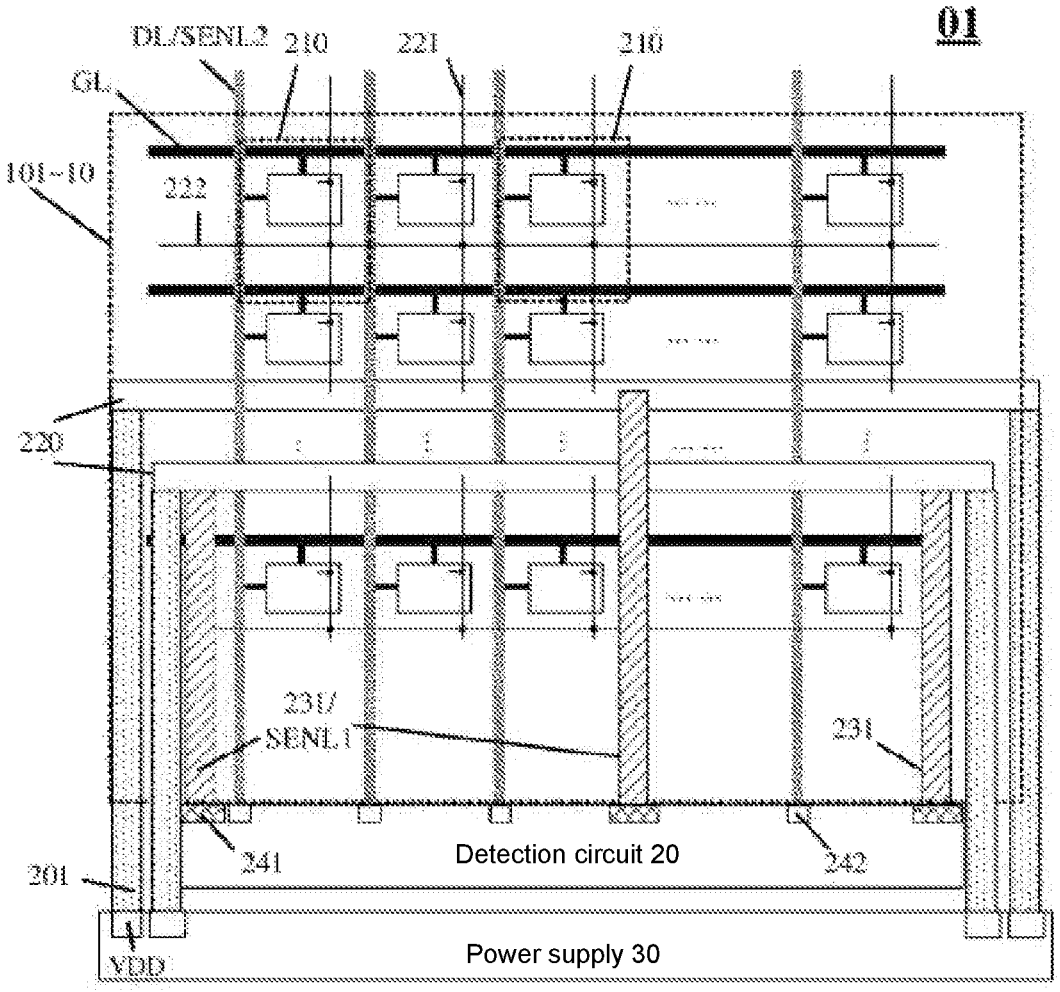
FIG. 14 is yet another structural diagram of an array substrate, a display panel and a display apparatus, in accordance with some embodiments of the present disclosure.

FIG. 14 is a structural diagram of yet another example of the array substrate 101, the display panel 10 and the display apparatus 01 in some embodiments of the present disclosure. The array substrate 101, the display panel 10 and the display apparatus 01 shown in FIG. 14 are similar to the array substrate 101, the display panel 10 and the display apparatus 01 shown in FIG. 11, and thus only the difference between the two is described here, and the similarities will not be repeated.

For example, as shown in FIG. 14, a display area of the display panel 10 may be divided into two sub-display areas (not marked in the drawing), the display panel 10 (or the array substrate 101 in the display panel 10) includes two first power buses 220, and at least parts of the two first power buses 220 are located in the two sub-display areas, respectively. As shown in FIG. 14, first terminals (first terminals of first transistors T1) of driving sub-circuits 111 of pixel circuits 100 in all pixel units 210 in each sub-display area are electrically connected to a corresponding first power buses 220 (that is, the first terminals of the driving sub-circuits 111 of the pixel circuits 100 in all the pixel units 210 in each sub-display area are electrically connected to each other). Thus, the two first power buses 220 may supply power to the pixel units 210 in the two sub-display areas. The two first power buses 220 are connected to the first power supply terminal VDD of the power supply, so as to receive the first power supply voltage provided from the first power supply terminal VDD.

For example, as shown in FIG. 14, the array substrate 101 includes two groups of common sensing lines 231 (first sensing lines SENL1), and all pixel units 210 in each sub-display area share a same group of common sensing lines 231. That is, all the pixel units 210 in each sub-display area share a same first sensing line SENL1, and the first sensing line SENL1 is the common sensing line 231. As shown in FIG. 14, the two groups of common sensing lines 231 are electrically connected to the detection circuit 20, so as to provide first power voltages in the pixel units 210 in the two sub-display areas to the detection circuit 20.

For example, by dividing the display area of the display panel 10 into two sub-display areas, and electrically connecting all the pixel units 210 in each sub-display area to the corresponding first power buses 220, it is possible to reduce a difference (a maximum value of the difference) between a first power voltage received by the pixel unit 210 in the display panel 10 and a sensed first power voltage, thereby further improving the accuracy of the threshold detection.

It will be noted that, for the display panel 10 shown in FIG. 14, the two sub-display areas are not limited to be arranged side by side in the extending direction of the data lines DL. According to actual application needs, the two sub-display areas may also be arranged side by side in the extending direction of the gate lines GL. It will be noted that, the display panel 10 shown in FIG. 14 is not limited to be divided into two sub-display areas, and may also be divided into sub-display areas of other suitable number.

Figure 15:
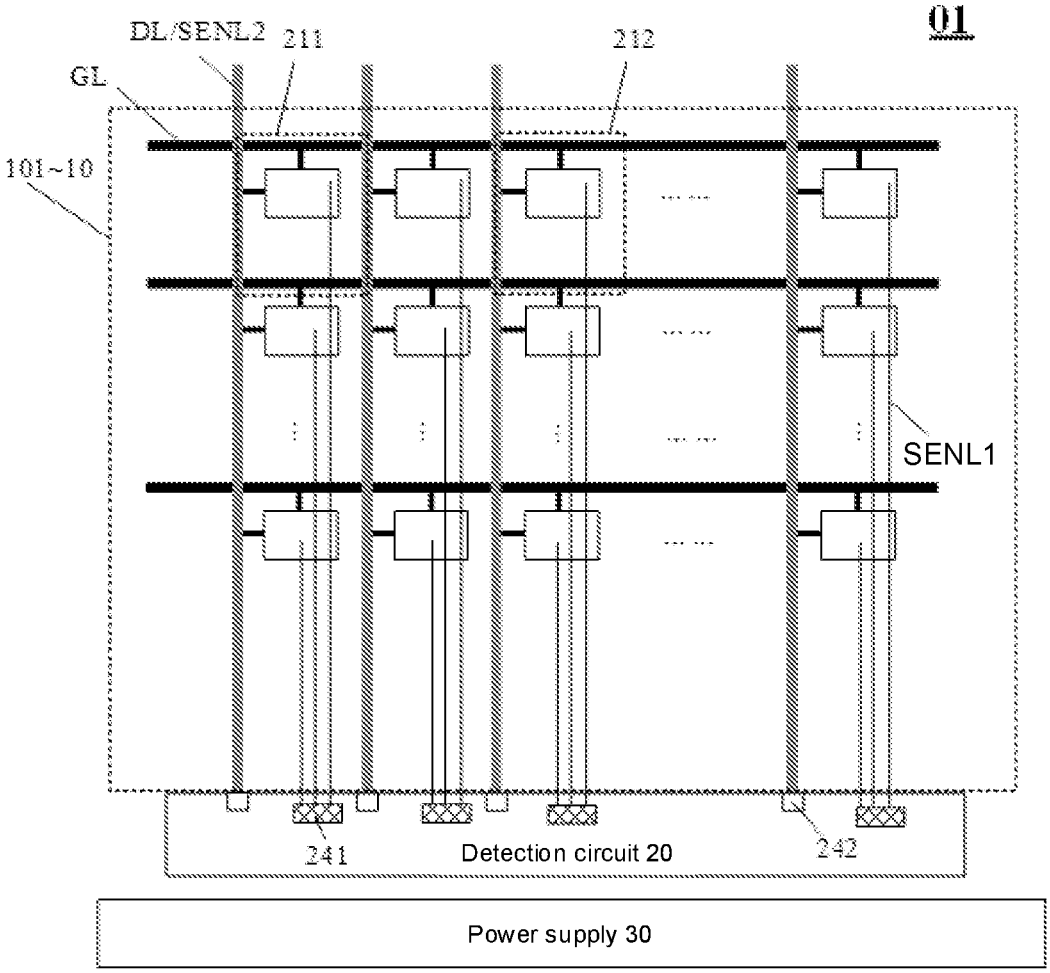
FIG. 15 is yet another structural diagram of an array substrate, a display panel and a display apparatus, in accordance with some embodiments of the present disclosure.

FIG. 15 is a structural diagram of yet another example of the array substrate 101, the display panel 10 and the display apparatus 01 in some embodiments of the present disclosure. The array substrate 101, the display panel 10 and the display apparatus 01 shown in FIG. 15 are similar to the array substrate 101, the display panel 10 and the display apparatus 01 shown in FIG. 11, and thus only the difference between the two is described here, and the similarities will not be repeated.

For example, as shown in FIG. 15, the array substrate 101 does not include the first power bus 220, and the pixel units 210 in the array substrate 101 (the first terminals of the driving sub-circuits 111 in the pixel circuits 100 in the pixel units 210) are connected to the first power supply terminal VDD of the power supply 30. As shown in FIG. 15, the array substrate 101 includes a plurality of first sensing lines SENL1, and the first sensing lines SENL1 in the plurality of pixel units 210 are independent of each other. That is, the pixel circuit 100 in each of the plurality of pixel units 210 is electrically connected to one first sensing line SENL1, the plurality of pixel units 210 do not share the first sensing line SENL1. The first sensing lines SENL1 in the plurality of pixel units 210 extend to the detection circuit 20 in a form of wiring.

For example, as shown in FIG. 15, the plurality of pixel units 210 includes first pixel units 211 and second pixel units 212, and the first sensing line SENL1 of the first pixel unit 211 and the first sensing line SENL1 of the second pixel unit 212 are independent of each other. For example, as shown in FIG. 15, the first sensing line SENL1 of the first pixel unit 211 extends from a position at which the first pixel unit 211 is located to the detection circuit 20 in the form of wiring, or/and the first sensing line SENL1 of the second pixel unit 212 extends from a position at which the second pixel unit 212 is located to the detection circuit 20 in the form of wiring.

For example, by making the first sensing lines SENL1 of the plurality of pixel units 210 independent of each other, the difference between the first power voltage received by the pixel unit 210 and the first power voltage sensed by the first sensing line SENL1 may be further reduced, and thus the accuracy of the threshold detection may be further improved.

It will be noted that, other components (for example, a control apparatus, an image data encoding/decoding apparatus or a clock circuit) of the display panel 10 and the display apparatus 01 may adopt applicable parts, and these should be understood by those of ordinary skill in the art, which will not be repeated here, and should not be regarded as limitations on the present disclosure.

At least one embodiment of the present disclosure further provides the detection method of the pixel circuit. The pixel circuit 100 includes the driving sub-circuit 111, and the driving sub-circuit 111 includes the driving transistor (i.e., the first transistor). The detection method includes: detecting the voltage of the first terminal of the driving transistor through the first sensing line SENL1, and detecting the voltage of the control terminal of the driving transistor through the second sensing line SENL2. The first terminal of the driving transistor is configured to be electrically connected to the first power supply terminal, so as to receive the first power supply voltage provided from the first power supply terminal. The voltage of the first terminal of the driving transistor and the voltage of the control terminal of the driving transistor are configured to obtain the threshold voltage of the driving transistor in the pixel circuit. For example, the threshold voltage is equal to the difference value between the voltage of the control terminal of the driving transistor and the voltage of the first terminal of the driving transistor.

For example, the accuracy of the threshold detection and the display effects of both the display panel and the display apparatus including the pixel circuit may be improved by detecting the voltage of the first terminal of the driving transistor through the first sensing line and detecting the voltage of the control terminal of the driving transistor through the second sensing line.

For example, the specific implementation of the detection method of the pixel circuit may be referred to the foregoing embodiments of the pixel circuit, which will not be repeated here.

At least one embodiment of the present disclosure further provides the driving method of the display apparatus. The display apparatus includes the pixel circuit. The driving method includes following steps S101 and S102.

In S101, any detection method in at least one embodiment of the present disclosure is performed on the pixel circuit, so as to obtain the threshold voltage of the driving transistor (i.e., the first transistor) in the pixel circuit.

In S102, the threshold voltage is used to be combined with the data signal to be applied to the pixel circuit to drive the pixel circuit.

For example, the threshold voltage may be used to be combined with the data signal to be applied to the pixel circuit to obtain the corrected data signal, and the pixel circuit may be driven based on the corrected data signal in the light-emitting phase (for example, the display phase of the display panel including the pixel circuit). For example, a calculation method of the corrected data signal may be referred to the calculation method in the pixel circuit and the display panel in at least one embodiment of the present disclosure, which will not be repeated here. For example, the driving method of the display apparatus in at least one embodiment of the present disclosure may improve the display effects of the display apparatus.

The foregoing descriptions are merely specific implementations of the present disclosure, but the protection scope of the present disclosure is not limited thereto. Changes or replacements that any person skilled in the art could conceive of within the technical scope of the present disclosure should be included in the protection scope of the present disclosure. Therefore, the protection scope of the present disclosure shall be subject to the protection scope of the claims.

What is claimed is:

1. A pixel unit, comprising a pixel circuit, a light-emitting element, a first sensing line and a second sensing line, wherein the pixel circuit is electrically connected to the light-emitting element, and the pixel circuit includes a driving sub-circuit configured to drive the light-emitting element electrically connected to the pixel circuit to emit light;

the driving sub-circuit has a control terminal, a first terminal and a second terminal;

the first terminal of the driving sub-circuit is configured to be electrically connected to a first power supply terminal, so as to receive a first power voltage provided by the first power supply terminal; the first terminal of the driving sub-circuit is further directly electrically connected to the first sensing line;

the second terminal of the driving sub-circuit is electrically connected to the light-emitting element; and the control terminal of the driving sub-circuit is electrically connected to the second sensing line;

the first sensing line is configured to sense a voltage of the first terminal of the driving sub-circuit;

the second sensing line is configured to sense a voltage of the control terminal of the driving sub-circuit;

the pixel circuit further includes a compensation connection sub-circuit, a first storage sub-circuit and a sensing connection sub-circuit;

the compensation connection sub-circuit is electrically connected to the control terminal and the second terminal of the driving sub-circuit; the compensation connection sub-circuit is configured to receive a first sensing control signal, and electrically connect the second terminal of the driving sub-circuit and the control terminal of the driving sub-circuit;

the first storage sub-circuit is electrically connected to the control terminal and the first terminal of the driving sub-circuit; the first storage sub-circuit is configured to store a signal written into the control terminal of the driving sub-circuit; and the sensing connection sub-circuit is electrically connected to the control terminal of the driving sub-circuit; the sensing connection sub-circuit is further electrically connected to the second sensing line; and the sensing connection sub-circuit is configured to receive a second sensing control signal, and electrically connect the control terminal of the driving sub-circuit to the second sensing line.

2. The pixel unit according to claim 1, wherein the driving sub-circuit includes a first transistor;

a control terminal of the first transistor is the control terminal of the driving sub-circuit, a first terminal of the first transistor is the first terminal of the driving sub-circuit, and a second terminal of the first transistor is the second terminal of the driving sub-circuit.

3. The pixel unit according to claim 1, wherein the compensation connection sub-circuit includes a second transistor; a control terminal of the second transistor is configured to receive the first sensing control signal, a first terminal of the second transistor is electrically connected to the control terminal of the driving sub-circuit, and a second terminal of the second transistor is electrically connected to the second terminal of the driving sub-circuit;

the first storage sub-circuit includes a first storage capacitor; a first terminal of the first storage capacitor is electrically connected to the control terminal of the driving sub-circuit, and a second terminal of the first storage capacitor is electrically connected to the first terminal of the driving sub-circuit;

the sensing connection sub-circuit includes a third transistor; a control terminal of the third transistor is configured to receive the second sensing control signal, a first terminal of the third transistor is electrically connected to the control terminal of the driving sub-circuit, and a second terminal of the third transistor is electrically connected to the second sensing line.

4. The pixel unit according to claim 3, wherein the control terminal of the second transistor is configured to be electrically connected to a first sensing control line, the control terminal of the third transistor is configured to be electrically connected to a second sensing control line, and the first sensing control line and the second sensing control line are a same control line; or the control terminal of the second transistor is configured to be electrically connected to a first sensing control line, the control terminal of the third transistor is configured to be electrically connected to a second sensing control line, and the first sensing control line and the second sensing control line are different control lines; and the second sensing line is also used as a data line.

5. The pixel unit according to claim 1, wherein the pixel circuit further includes a reset sub-circuit, and the reset sub-circuit is electrically connected to the second sensing line;

the reset sub-circuit is configured to receive a reset control signal and a reset signal, so as to perform a reset operation on the control terminal of the driving sub-circuit.

6. The pixel unit according to claim 5, wherein the reset sub-circuit includes a fourth transistor; a control terminal of the fourth transistor is configured to receive the reset control signal, a first terminal of the fourth transistor is configured to receive the reset signal, and a second terminal of the fourth transistor is electrically connected to the second sensing line.

7. The pixel unit according to claim 1, wherein the pixel circuit further includes a data writing sub-circuit, wherein the data writing sub-circuit is electrically connected to the control terminal of the driving sub-circuit;

the pixel unit further includes a data line, and the data writing sub-circuit is further electrically connected to the data line; or the second sensing line is also used as a data line, and the data writing sub-circuit is further electrically connected to the second sensing line;

the data writing sub-circuit is configured to receive a scan control signal, and write a data signal into the control terminal of the driving sub-circuit.

8. The pixel unit according to claim 7, wherein the data writing sub-circuit includes a fifth transistor; a control terminal of the fifth transistor is configured to receive the scan control signal, a first terminal of the fifth transistor is electrically connected to the second sensing line or the data line, and a second terminal of the fifth transistor is electrically connected to the control terminal of the driving sub-circuit.

9. The pixel unit according to claim 1, wherein the second terminal of the driving sub-circuit is electrically connected to a first terminal of the light-emitting element;

the pixel circuit further includes a voltage selection sub-circuit;

the voltage selection sub-circuit is configured to selectively electrically connect a second terminal of the light-emitting element to one of the first power supply terminal and a second power supply terminal, the second power supply terminal is configured to provide a second power supply voltage, and the second power supply voltage is less than the first power supply voltage;

the voltage selection sub-circuit includes a first power supply voltage supply sub-circuit and a second power supply voltage supply sub-circuit;

the first power supply voltage supply sub-circuit is electrically connected to the first power supply terminal and the second terminal of the light-emitting element; the first power supply voltage supply sub-circuit is configured to receive a third sensing control signal, and electrically connect the second terminal of the light-emitting element to the first power supply terminal; and the second power supply voltage supply sub-circuit is electrically connected to the second power supply terminal and the second terminal of the light-emitting element; the second power supply voltage supply sub-circuit is configured to receive a light-emitting control signal, and electrically connect the second terminal of the light-emitting element to the second power supply terminal.

10. The pixel unit according to claim 9, wherein the first power supply voltage supply sub-circuit includes a sixth transistor;

a control terminal of the sixth transistor is configured to receive the third sensing control signal, a first terminal of the sixth transistor is configured to be electrically connected to the first power supply terminal, and a second terminal of the sixth transistor is configured to be electrically connected to the second terminal of the light-emitting element;

the second power supply voltage supply sub-circuit includes a seventh transistor; a control terminal of the seventh transistor is configured to receive the light-emitting control signal, a first terminal of the seventh transistor is configured to be electrically connected to the second power supply terminal, and a second terminal of the seventh transistor is configured to be electrically connected to the second terminal of the light-emitting element.

11. The pixel unit according to claim 1, wherein the second terminal of the driving sub-circuit is electrically connected to a first terminal of the light-emitting element;

a second terminal of the light-emitting element is electrically connected to a variable power supply terminal, and the variable power supply terminal is configured to provide the first power supply voltage and a second power supply voltage;

wherein the second power supply voltage is less than the first power supply voltage.

12. The pixel unit according to claim 1, wherein the driving sub-circuit includes a first transistor; a control terminal of the first transistor is the control terminal of the driving sub-circuit, a first terminal of the first transistor is the first terminal of the driving sub-circuit, and a second terminal of the first transistor is the second terminal of the driving sub-circuit;

the pixel circuit further includes a first storage capacitor, a second transistor, a third transistor, a fourth transistor, a fifth transistor, a sixth transistor and a seventh transistor;

the control terminal of the first transistor is electrically connected to a first node, the first terminal of the first transistor is configured to be electrically connected to the first power supply terminal, and the second terminal of the first transistor is electrically connected to a second node;

a first terminal of the first storage capacitor is electrically connected to the first node, and a second terminal of the first storage capacitor is electrically connected to the first terminal of the first transistor;

a control terminal of the second transistor is configured to receive a first sensing control signal, a first terminal of the second transistor is electrically connected to the first node, and a second terminal of the second transistor is electrically connected to the second node;

a control terminal of the third transistor is configured to receive a second sensing control signal, a first terminal of the third transistor is electrically connected to the first node, and a second terminal of the third transistor is electrically connected to the second sensing line; the control terminal of the second transistor is configured to be electrically connected to a first sensing control line, the control terminal of the third transistor is configured to be electrically connected to a second sensing control line, and the first sensing control line and the second sensing control line are a same control line; or the control terminal of the second transistor is configured to be electrically connected to a first sensing control line, the control terminal of the third transistor is configured to be electrically connected to a second sensing control line, and the first sensing control line and the second sensing control line are different control lines; and the second sensing line is also used as a data line;

a control terminal of the fourth transistor is configured to receive a reset control signal, a first terminal of the fourth transistor is configured to receive a reset signal, and a second terminal of the fourth transistor is electrically connected to the second sensing line;

a control terminal of the fifth transistor is configured to receive a scan control signal, a second terminal of the fifth transistor is electrically connected to the first node, and a first terminal of the fifth transistor is connected to the second sensing line, and the second sensing line is also used as the data line; or the pixel unit further includes a data line, and the first terminal of the fifth transistor is electrically connected to the data line;

a control terminal of the sixth transistor is configured to receive a third sensing control signal, a first terminal of the sixth transistor is configured to be electrically connected to the first power supply terminal, and a second terminal of the sixth transistor is configured to be electrically connected to a second terminal of the light-emitting element; and a control terminal of the seventh transistor is configured to receive a light-emitting control signal, a first terminal of the seventh transistor is configured to be electrically connected to a second power supply terminal, and a second terminal of the seventh transistor is configured to be electrically connected to the second terminal of the light-emitting element.

13. An array substrate, comprising a plurality of pixel units arranged in an array, wherein the plurality of pixel units are pixel units according to claim 1.

14. The array substrate according to claim 13, wherein at least two of the plurality of pixel units share a same first sensing line.

15. The array substrate according to claim 14, further comprising at least one first power bus, wherein the first power bus is configured to be electrically connected to the first power supply terminal, and is electrically connected to the plurality of pixel units, so as to provide the first power supply voltage to the plurality of pixel units; and the first sensing line is electrically connected to the first power bus.

16. The array substrate according to claim 13, wherein first sensing lines in the plurality of pixel units are independent of each other.

17. A display panel, comprising the array substrate according to claim 13.

18. A display apparatus, comprising:

the display panel according to claim 17;

a detection circuit, wherein the detection circuit includes at least one first signal terminal and a plurality of second signal terminals, the at least one first signal terminal is electrically connected to the first sensing line, and each of the plurality of second signal terminals is electrically connected to one second sensing line;

the detection circuit is configured to receive voltages detected by the first sensing line and the second sensing line, and to obtain a threshold voltage of a driving transistor in the pixel circuit electrically connected to the first sensing line and the second sensing line according to the received voltages.

19. A detection method of a pixel circuit, the pixel circuit being the pixel circuit in the pixel unit according to claim 1, the pixel circuit including the driving sub-circuit including a driving transistor, a first terminal of the driving transistor being directly electrically connected to the first sensing line, the detection method comprising:

detecting a voltage of the first terminal of the driving transistor through the first sensing line, and a voltage of a control terminal of the driving transistor through the second sensing line;

wherein the first terminal of the driving transistor is configured to be electrically connected to the first power supply terminal, so as to receive a first power supply voltage provided by the first power supply terminal, and the voltage of the first terminal of the driving transistor and the voltage of the control terminal of the driving transistor are configured to obtain a threshold voltage of the driving transistor in the pixel circuit;

the threshold voltage is equal to a difference value between the voltage of the control terminal of the driving transistor and the voltage of the first terminal of the driving transistor.

* * * * *